US007664272B2

(12) United States Patent
Terai et al.

(10) Patent No.: US 7,664,272 B2
(45) Date of Patent: Feb. 16, 2010

(54) SOUND IMAGE CONTROL DEVICE AND DESIGN TOOL THEREFOR

(75) Inventors: Kenichi Terai, Shijohnawate (JP); Kazutaka Abe, Kandoma (JP); Isao Kakuhari, Ikoma (JP); Yasuhito Watanabe, Yokohama (JP); Gempo Ito, Yokohama (JP)

(73) Assignee: Panasonic Corporation, Osaka (JP)

( * ) Notice: Subject to any disclaimer, the term of this patent is extended or adjusted under 35 U.S.C. 154(b) by 455 days.

(21) Appl. No.: 10/554,595

(22) PCT Filed: Sep. 2, 2004

(86) PCT No.: PCT/JP2004/013091

§ 371 (c)(1),
(2), (4) Date: Oct. 26, 2005

(87) PCT Pub. No.: WO2005/025270

PCT Pub. Date: Mar. 17, 2005

(65) Prior Publication Data

US 2006/0274901 A1 Dec. 7, 2006

(30) Foreign Application Priority Data

Sep. 8, 2003 (JP) ..... 2003-315393

(51) Int. Cl.
*H04R 5/00* (2006.01)

(52) U.S. Cl. ..... 381/17; 381/1; 381/309; 381/310

(58) Field of Classification Search ..... 381/1, 381/16–18, 306, 309–310, 58–59, 103, 26, 381/74

See application file for complete search history.

(56) References Cited

U.S. PATENT DOCUMENTS

| | | | | |
|---|---|---|---|---|
| 6,223,090 | B1 * | 4/2001 | Brungart | 700/28 |
| 6,731,759 | B2 * | 5/2004 | Terai et al. | 381/17 |
| 6,795,556 | B1 * | 9/2004 | Sibbald et al. | 381/17 |
| 6,956,955 | B1 * | 10/2005 | Brungart | 381/310 |
| 6,961,439 | B2 * | 11/2005 | Ballas | 381/309 |
| 6,996,244 | B1 * | 2/2006 | Slaney et al. | 381/303 |

(Continued)

FOREIGN PATENT DOCUMENTS

| | | |
|---|---|---|
| CA | 2 439 587 | 8/2003 |

(Continued)

*Primary Examiner*—Vivian Chin
*Assistant Examiner*—Disler Paul
(74) *Attorney, Agent, or Firm*—Wenderoth, Lind & Ponack, L.L.P.

(57) ABSTRACT

A sound image control device filters transfer functions H3 and H1 indicating transfer characteristics of a sound from an acoustic transducer (8) to entrances to respective ear canals (1) and (2) as well as filtering transfer functions H4 and H2 from an acoustic transducer (9) to the entrances to the respective ear canals (1) and (2) and generates second transfer functions H6 and H5 indicating transfer characteristics of a sound to the entrances to the respective ear canals (1) and (2) from a target sound source (11) at a location different from the sound sources, the sound image control device being equipped with correction filters (13) and (14) that (i) store characteristic functions E1 and E2 for performing filtering operations on the first transfer functions H1, H2, H3, and H4 and (ii) generate the second transfer functions H5 and H6 from the first transfer functions H1, H2, H3, and H4 using such characteristic functions E1 and E2.

13 Claims, 39 Drawing Sheets

U.S. PATENT DOCUMENTS

| | | | | |
|---|---|---|---|---|
| 7,095,865 | B2 * | 8/2006 | Katayama et al. | 381/309 |
| 7,167,567 | B1 * | 1/2007 | Sibbald et al. | 381/17 |
| 7,197,151 | B1 * | 3/2007 | Sibbald et al. | 381/310 |
| 2001/0040968 | A1 * | 11/2001 | Mukojima | 381/17 |
| 2002/0051548 | A1 | 5/2002 | Terai et al. | |
| 2003/0147543 | A1 | 8/2003 | Katayama et al. | |

FOREIGN PATENT DOCUMENTS

| | | |
|---|---|---|
| EP | 1 058 481 | 12/2000 |
| EP | 1 408 718 | 4/2004 |
| GB | 2 351 213 | 12/2000 |
| JP | 2548103 | 8/1996 |
| JP | 9-298800 | 11/1997 |
| JP | 2001-016697 | 1/2001 |
| JP | 2001-285998 | 10/2001 |
| JP | 2002-95097 | 3/2002 |
| JP | 2002-095098 | 3/2002 |
| JP | 2003-102099 | 4/2003 |
| JP | 2003-230199 | 8/2003 |
| JP | 2004-526364 | 8/2004 |
| WO | 02/007197 | 9/2002 |
| WO | 02/071794 | 9/2002 |
| WO | 03/009643 | 1/2003 |

* cited by examiner

FIG. 22

| | Head width | Head height | Head depth |
|---|---|---|---|
| Head model 3 (Dummy head) | Wd | Hd | Dd |
| Head model 35 (Male average) | Wm | Hm | Dm |
| Head model 36 (Female average) | Ww | Hw | Dw |
| Head model 37 (Children average) | Wc | Hc | Dc |

| Head width w1 | | Head height | | |
|---|---|---|---|---|
| | | h1 | h2 | h3 |
| Head depth | d1 | M51 | M52 | M53 |
| | d2 | M54 | M55 | M56 |
| | d3 | M57 | M58 | M59 |

FIG. 24A

| Head width w2 | | Head height | | |
|---|---|---|---|---|
| | | h1 | h2 | h3 |
| Head depth | d1 | M61 | M62 | M63 |
| | d2 | M64 | M65 | M66 |
| | d3 | M67 | M68 | M69 |

FIG. 24B

| Head width w3 | | Head height | | |
|---|---|---|---|---|
| | | h1 | h2 | h3 |
| Head depth | d1 | M71 | M72 | M73 |
| | d2 | M74 | M75 | M76 |
| | d3 | M77 | M78 | M79 |

FIG. 24C

FIG. 27

| | | Pinna height | | |
|---|---|---|---|---|
| | | eh1 | eh2 | eh3 |
| Pinna width | ed1 | M91 | M92 | M93 |
| | ed2 | M94 | M95 | M96 |
| | ed3 | M97 | M98 | M99 |

93
E1-91
E2-91
E1-92
E2-92
E1-99
E2-99
96
eh1
eh2
eh3
ed1
ed2
ed3
94
95
14
13
12
9
8
H1
H2
H3
H4
1
2
3

SOUND IMAGE CONTROL DEVICE AND DESIGN TOOL THEREFOR

TECHNICAL FIELD

The present invention relates to a sound image control device that localizes, using a sound transducer such as a speaker and a headphone, a sound image at a position other than where such sound transducer exists, and relates to a design tool for designing a sound image control device.

BACKGROUND ART

Conventionally, a method has been known for representing the sound transmitted from a speaker to the ears using head-related transfer functions (HRTF(s)). HRTFs are functions that represent how the sound being generated from the speaker (sound source) sounds to the ears. By applying filtering on the sound source such as a speaker using such HRTFs, it is possible to give a person a feeling that there is a sound source in a location where such sound source does not actually exist. This processing is referred to as "localizing a sound image" at the location. The HRTFs can be determined either by actual measurement or by calculations. The successful application of this technology makes it possible to resolve a problem that some people feel as if the sound source existed inside their heads when using a headphone and to produce the effect of giving a sense of realism to the listener listening to the sound from a small stereo equipped to a mobile phone or the like as if such sound were coming from a large stereo.

FIG. 1A is a diagram showing an example conventional method for determining HRTFs by actual measurement. In general, the measurement of HRTFs is carried out inside an anechoic chamber where there is no reverberation of sound from the wall or the floor, using a test subject or a measuring manikin with the standard dimensions called a dummy head. In FIG. 1A, a measuring speaker is placed about a meter away from the dummy head and transfer functions from the speaker to both ears of the dummy head are measured. Microphones are placed inside the respective ears (auditory tubes) of the dummy head. These microphones receive specific sound impulses emitted from the speaker. In this drawing, "A" denotes a response from the ear further from the speaker (far-ear response) and "S" denotes a response from the ear nearer to the speaker (near-ear response). As described above, by recording responses of the microphones to impulses from the speaker, with the speaker moved at various azimuthal and elevation angles with respect to the dummy head, it is possible to determine HRTFs between sound sources at various locations and the respective ears.

FIG. 1B is a block diagram showing the structure of a conventional sound image control device. As shown in FIG. 1B, such sound image control device modifies the HRTFs measured as shown in FIG. 1A by performing signal processing on the time domain and frequency domain. In other words, processing is performed on an input signal for the near-ear response, far-ear response, and inter-aural time delay included in the HRTFs represented by the diagonally shaded block, so as to output headphone signals. Variations among listeners are supported as follows: for a listener whose ear size is larger than the standard dimensions, resonance frequencies of the respective frequency response characteristics of the near-ear response and the far-ear response are reduced according to the ratio of the difference from the standard dimension; and for a listener whose head dimensions are larger than the standard dimensions, a time delay is increased according to the ratio of the difference from the standard dimension. Such technology is disclosed in Japanese Laid-Open Patent application No. 2001-16697 (page 9).

FIG. 2 is a diagram showing an example conventional technology for calculating HRTFs for plural sound sources using a three-dimensional head model represented on a calculator. In order to calculate HRTFs on a calculator, a three-dimensional shape of a head such as a dummy head is loaded into the calculator, so as to use it as a head model. In this drawing, each intersection of the mesh illustrated on the outer surface of the head model is referred to as a "nodal point". Each nodal point is identified by three-dimensional coordinates. In the case of determining HRTFs by calculations, the potential at each nodal point on the head model is calculated for each sound source (sound emitting point), and the sound pressures of calculated potentials at the respective nodal points are combined. FIG. 2 illustrates the case of determining HRTFs when sound sources are placed at angles of 0 degrees, 30 degrees, 60 degrees, and 90 degrees, respectively, with respect to the right ear of the head model. In this case, it is possible to calculate HRTFs when the sound sources are placed at the angles of 0 degrees, 30 degrees, 60 degrees, and 90 degrees by calculating the potential at each nodal point when the sound source is placed at the 0 degree angle, the potential at each nodal point when the sound source is placed at the 30 degree angle, the potential at each nodal point when the sound source is placed at the 60 degree angle, and the potential at each nodal point when the sound source is placed at the 90 degree angle.

However, such conventional structure requires the measurement of an enormous number of transfer functions in the case of measuring detailed variations in azimuthal and elevation angles. With regard to this, there are the following problems: (1) it is difficult to stabilize a measurement condition each time the location of the speaker is changed; (2) the size of microphones used for measurement cannot be ignored while the size of ear canals is ignorable; and (3) due to such reasons as that the size of the speaker has an affect on the sound field in the case where HRTFs are measured in the vicinity of the head, highly accurate HRTFs cannot be obtained, and thus in the case where an acoustic transducer located in the vicinity of one meter or less away from the head is used, it is difficult to control sound images correctly. Furthermore, also in the case where HRTFs are determined on a calculator, while it is desired to calculate HRTFs with the sound source being placed in a larger number of different locations, there is a problem in that it requires the calculation of the potential of each of an enormous number of nodal points each time the location of the sound source is changed.

There is also a problem in that, since modification of transfer functions according to head dimensions is made by adjusting an inter-ear delay time in the case where the head is regarded simply as a sphere, variations in the frequency characteristics attributable to an interference between sounds that diffract around the head cannot be reproduced and thus differences in the effect of sound image control among individuals cannot be reduced.

The present invention aims at solving the above problems, and it is an object of the present invention to determine enormous kinds of transfer functions for different azimuthal and elevation angles and different distances in a highly accurate manner under the same condition.

A second object is to provide a sound image control device that is capable of obtaining precise localization of sound images even in the case of using an acoustic transducer located in the vicinity of the head by obtaining a highly accurate transfer function even when an acoustic transducer is located in the vicinity of the head.

A third object is to provide a sound image control device that is capable of supporting individual differences in sound interference that varies depending on head dimensions as well as differences in the internal shape of ear canals and thus capable of reducing individual differences in the effect of sound image control.

SUMMARY OF INVENTION

In order to solve the above problems, the design tool of the present invention is a design tool for designing a sound image control device that generates a second transfer function by filtering a first transfer function indicating a transfer characteristic of a sound from a sound source to a sound receiving point on a head, the second transfer function indicating a transfer characteristic of a sound from a target sound source to the sound receiving point on the head, the target sound source being at a location different from a location of the sound source, the design tool including a transfer function generation unit that determines the respective transfer functions using the sound receiving point on the head as a sound emitting point and using the sound source and the target sound source as sound receiving points. With this structure, by previously calculating the potentials at the respective nodal points by use of the entrances to the respective ear canals or eardrums as sound emitting points, it is possible to accurately determine transfer functions under the same condition even when a sound receiving point is moved to many locations.

Furthermore, since head-related transfer functions are calculated on a calculator, it is possible to realize sound emission at an ideal point sound source and fully non-directional sound receiving which cannot be realized by actual measurement, as well as it is possible to correctly calculate head-related transfer functions for a close location. Accordingly, it becomes possible to achieve more precise localization of sound images.

Moreover, since the entrances to the respective ear canals and eardrums serve as sound emitting points, it is possible to achieve precise localization of sound images even when acoustic transducers located close to the head is used, by obtaining highly precise transfer functions even when acoustic transducers are located close to the head.

In the sound image control device according to the present invention, the characteristic function is calculated based on plural types of head models whose size of each part on a head is different from another head model, the characteristic function storage unit stores the characteristic function for each of the plural types, the sound image control device further includes an item input unit that accepts, from a listener, an input of an item for determining one of the plural types, and the second transfer function generation unit generates the second transfer function using the characteristic function corresponding to the type that is determined based on the input. Thus, by the listener inputting items indicating a type optimum to the shape of his/her head, it is possible to support individual differences in sound interference that varies depending on head dimensions as well as differences in the internal shape of ear canals and to reduce individual differences in the effect of sound image control.

Note that it is not only possible to embody the present invention as the above-described design tool for designing a sound image control device and the above-described sound image control device, but also as a design method for designing a sound image control device and a sound image control method that include, as their steps, characteristic units included in the above design tool for designing a sound image control device and the above sound image control device, and as programs that cause a computer to execute the respective steps. It should be also noted that each of such programs can be distributed on a storage medium such as a CD-ROM or over a transmission medium such as the Internet.

According to the present invention, precise localization of sound images is achieved even when acoustic transducers located close to the head are used since it is possible to accurately obtain enormous kinds of transfer functions for different azimuthal angles, elevation angles, and distances between a sound source and a head model under the same condition at high speed and to obtain highly precise transfer functions even when the acoustic transducers are located close to the head. What is more, it is possible to support individual differences in sound interference that varies depending on head dimensions as well as differences in the internal shape of ear canals and thus to reduce individual differences in the effect of sound image control.

BRIEF DESCRIPTION OF DRAWINGS

FIG. 22 is a table showing specific categories in a parent population to which a sound image control device of a sixth embodiment is provided.

FIG. 24A is a table showing an example of head models M51 to M59 categorized into the group with the head width w1. FIG. 24B is a table showing an example of head models M61 to M69 categorized into the group with the head width w2. FIG. 24C is a table showing an example of head models M71 to M79 categorized into the group with the head width w3.

FIG. 27 is a table showing a further another example of specific categories in a parent population to which a sound image control device of the seventh embodiment is provided.

DETAILED DESCRIPTION OF PREFERRED EMBODIMENTS

The following describes the embodiments of the present invention with reference to FIG. 3 to FIG. 39B.

First Embodiment

A sound image control device according to the first embodiment of the present invention obtains precise localization of sound images by determining transfer functions by use of a three-dimensional head model that has a human body shape and is represented on a calculator, according to a calculation model in which the positions of sound sources and sound receiving points are reversed, by means of numerical calculations employing the boundary element method, and then by controlling sound images using such transfer functions.

Details about the boundary element method are introduced, for example, in "Masataka TANAKA, et. al, "kyoukai youso hou (Boundary Element Method)", pp. 40-42 and pp. 111-128, 1991, Baifukan Inc.) (hereinafter referred to as "Non-patent document 1").

Using this boundary element method, it is possible to perform such a calculation as is described in "Papers of 2001 Autumn Meeting of Acoustical Society of Japan (pp. 403-404)) (hereinafter referred to as "Non-Patent Document 2"). According to this Non-Patent Document 2, the result of comparing a calculation result obtained by the boundary element method with transfer functions shows favorable agreement, the transfer functions representing a sound from sound sources to the entrances to the ear canals of a finely created real-size model corresponding to a three-dimensional model represented on a calculator. While this document defines that the frequency range is 7.3 kHz or lower, it is obvious that results of actual measurement and numerical calculations for the entire range audible to human ears agree by increasing the accuracy of the model on the calculator and shortening the spacing between each two nodal points.

Figure 1A:
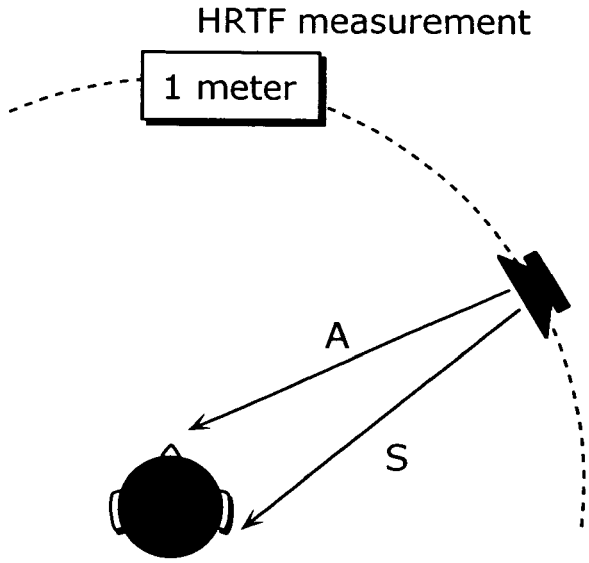
FIG. 1A is a diagram showing an example conventional method for determining HRTFs by actual measurement.
Figure 1B:
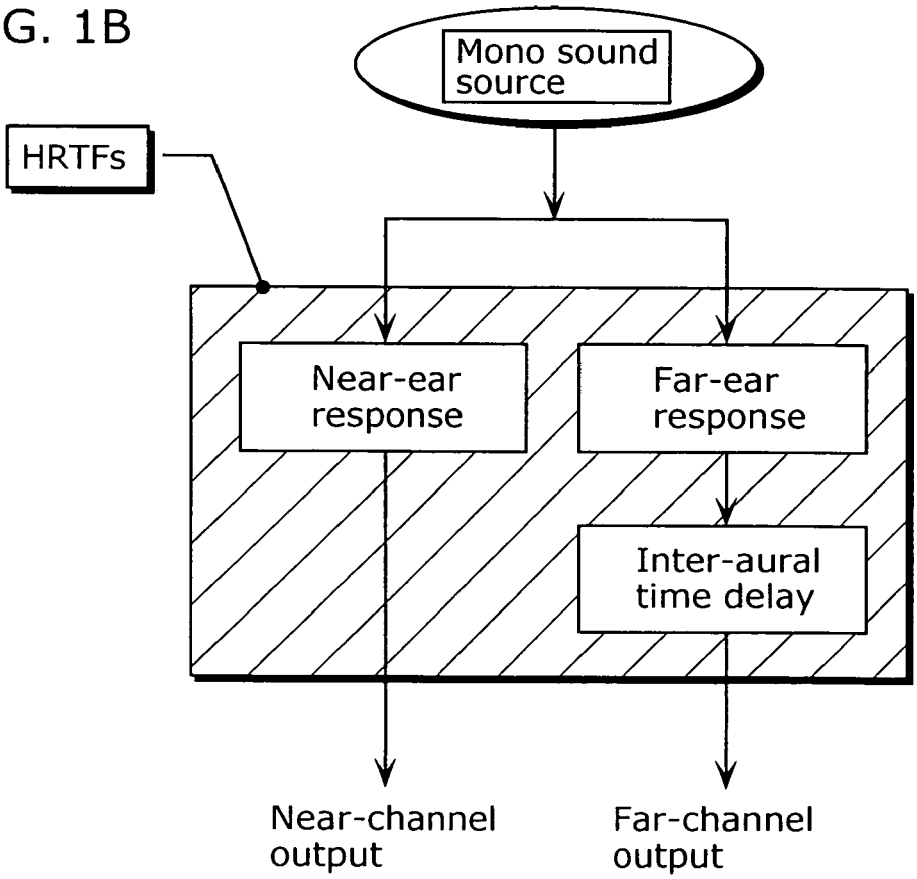
FIG. 1B is a block diagram showing a structure of a conventional sound image control device.
Figure 2:
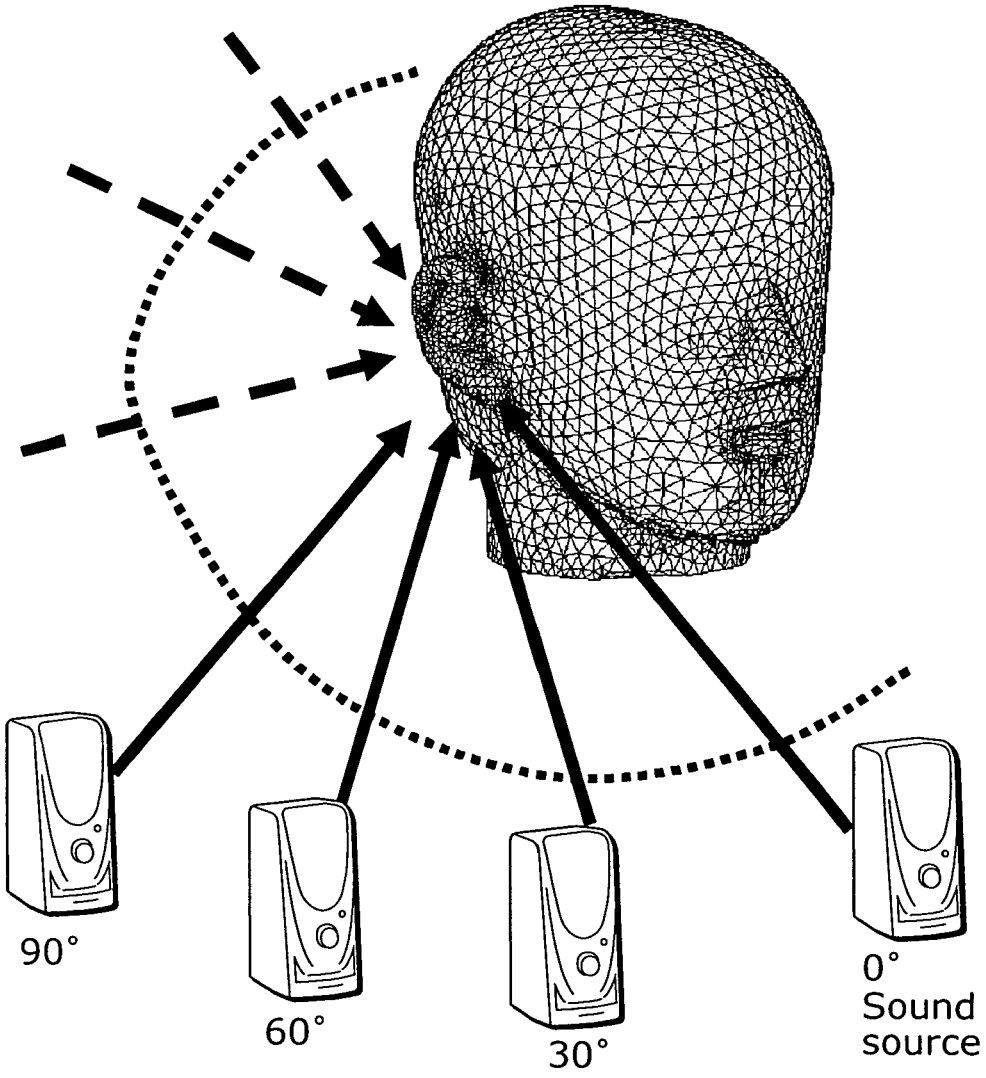
FIG. 2 is a diagram showing an exemplary conventional technology for calculating HRTFs for plural sound sources using a three-dimensional head model represented on a calculator.
Figure 3B:
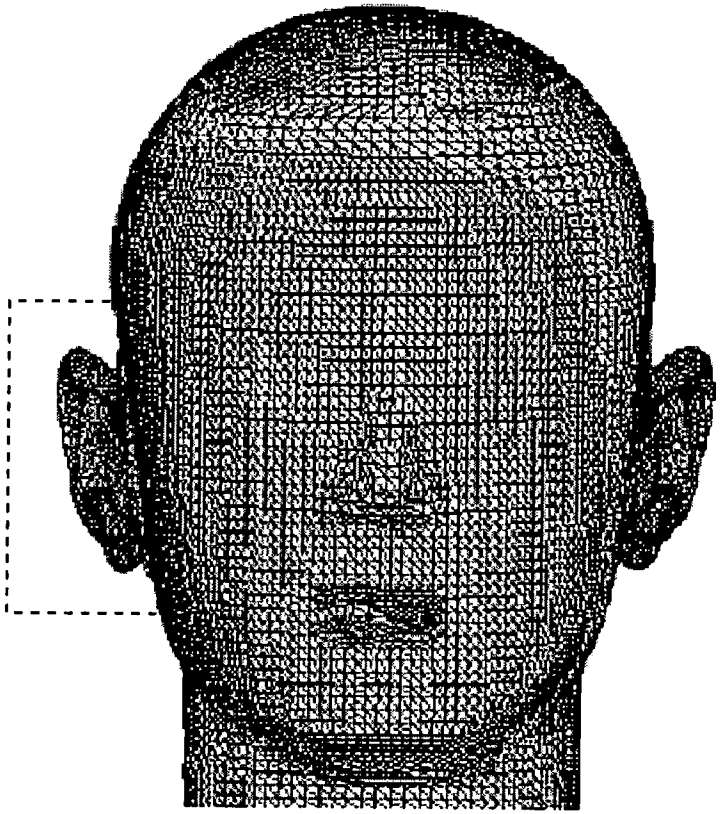
FIG. 3B is a front view showing the head model.
Figure 3A:
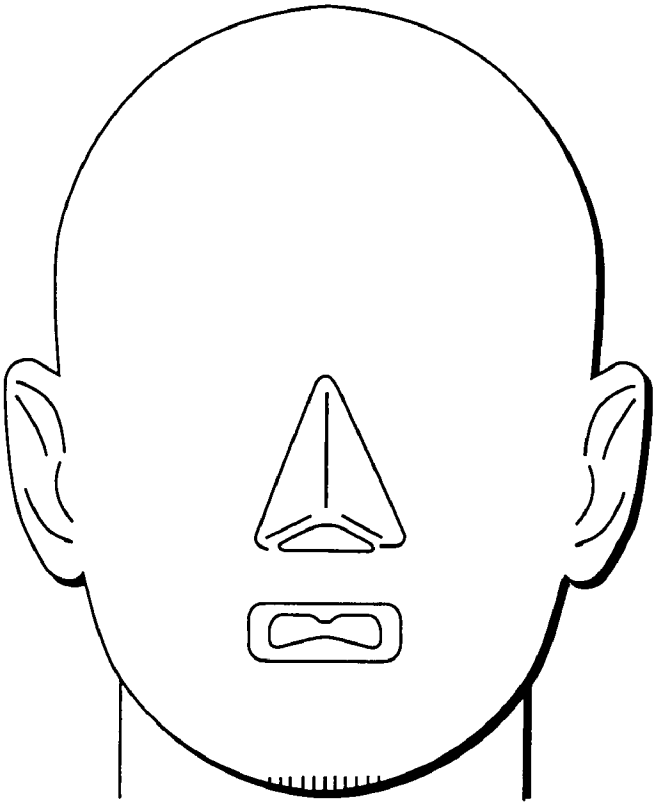
FIG. 3A is a diagram showing an example of an actual dummy head used to calculate HRTFs.
Figure 4B:
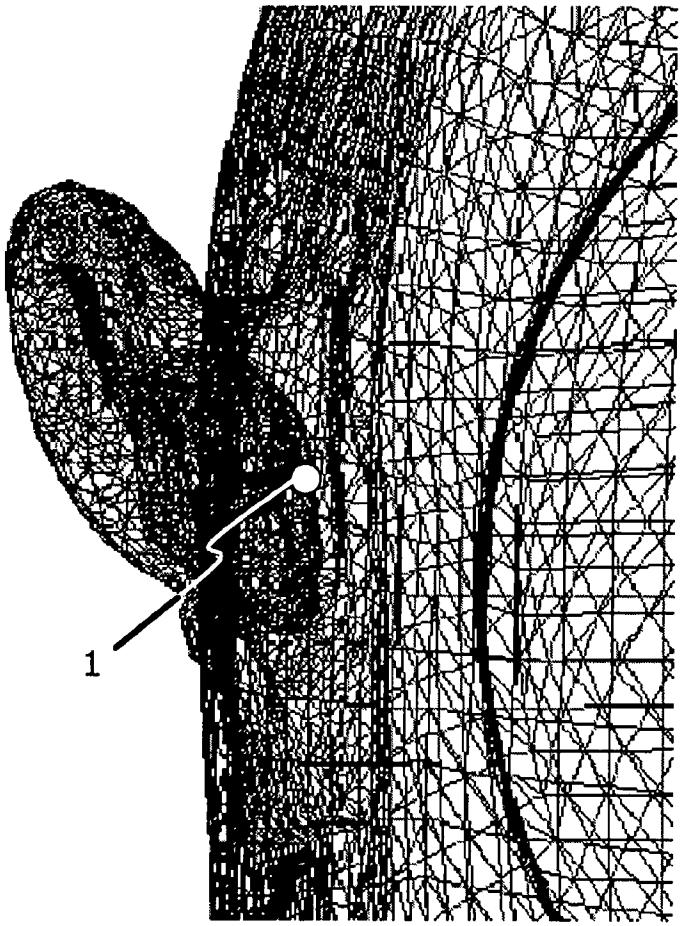
FIG. 4B is an enlarged top view showing the right pinna region of the head model according to the first embodiment.
Figure 4A:
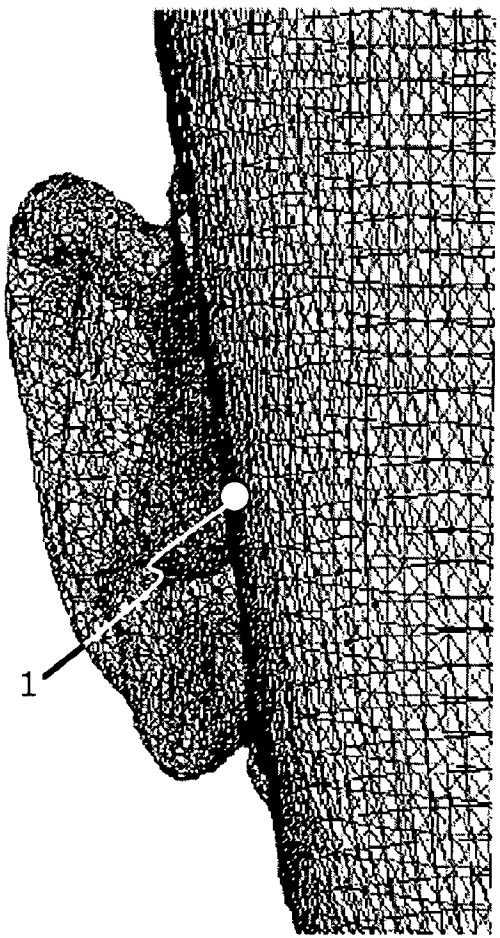
FIG. 4A is an enlarged front view showing the right pinna region of the head model according to a first embodiment.

FIG. 3 shows a head model used to determine transfer functions in the sound image control device according to the first embodiment. FIG. 3A is a diagram showing an example of an actual dummy head used to calculate HRTFs. First, the actual dummy head shown in FIG. 3A is precisely measured three-dimensionally using a laser scanner device or the like. The head model is structured based on magnetic resonance images and data of an X-ray computed tomograph in the field of medicine. FIG. 3B is a front view showing the head model obtained in the above manner. The following gives a detailed description of the right pinna region of the head indicated by the broken lines in this diagram. In the present embodiment, the potential of each nodal point of the mesh on the head model shown in FIG. 3B is calculated for each sound source. FIG. 4A is an enlarged front view showing the right pinna region of the head model according to the first embodiment, whereas FIG. 4B is an enlarged top view showing the right pinna region of the head model according to the first embodiment. In the head model of the present embodiment, the entrances 1 and 2 to the respective ear canals as well as the undersurface of the entire head model are covered with lids. The following describes concrete calculation models for determining HRTFs, using the above described head model.

Figure 5:
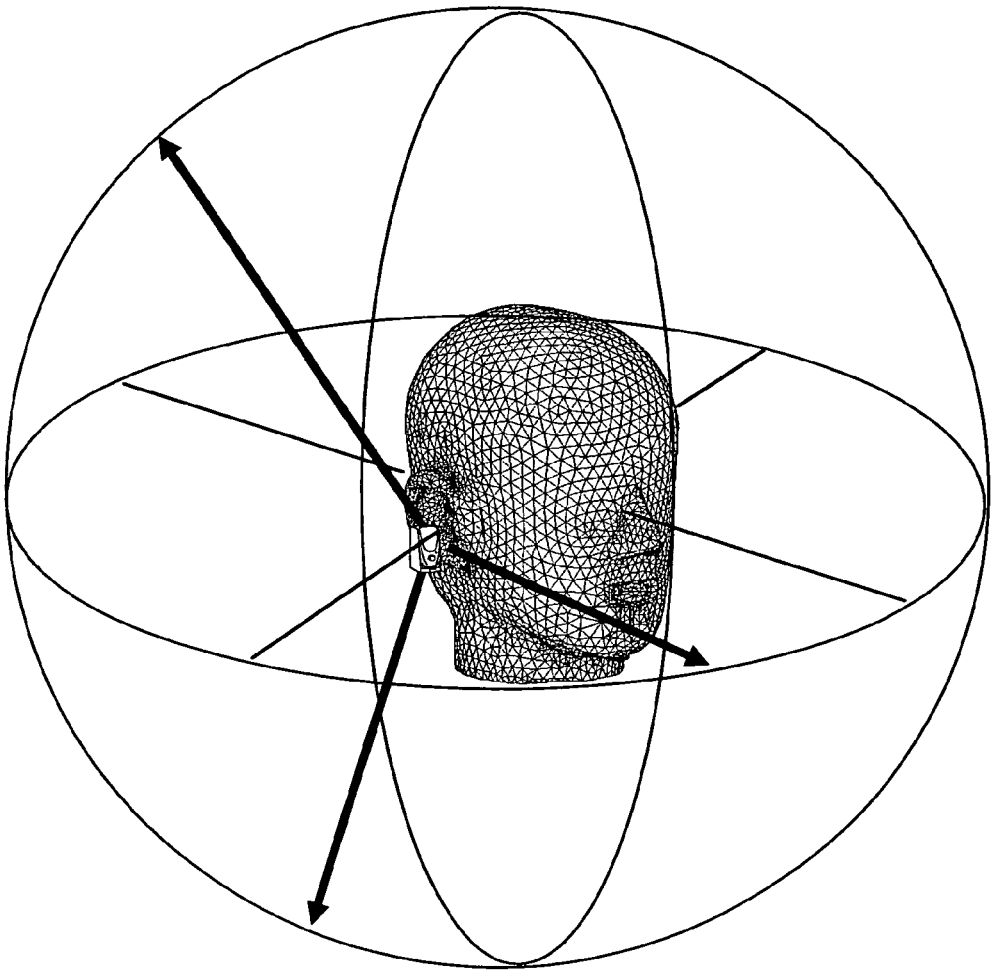
FIG. 5 is a diagram showing an example method for calculating HRTFs according to the first embodiment.

FIG. 5 is a diagram showing an example method for calculating HRTFs according to the first embodiment. In measurement and calculation methods for HRTFs, HRTFs to be obtained are the same regardless of if a sound emitting point and a sound receiving point are transposed. Utilizing this, a sound source is placed at each of the entrances to the respective ear canals of the head model. This structure requires a calculation to be performed to determine the potentials of the respective nodal points once for each sound source, i.e., only twice in total, since the sound sources are fixed at the entrances to the respective ear canals. Then, moving microphones that receive sound impulses from the sound sources to desired azimuthal angles, elevation angles, and positions with respect to the head model, transfer functions from the entrances to the respective ear canals, each serving as a sound emitting point, to the microphones, each serving as a sound receiving point, are calculated. HRTFs that are originally calculated each time the sound receiving points are moved can be calculated by combining the sound pressures of already determined potentials of the respective nodal points. The sound pressures on the sphere can be determined by one calculation, using the boundary element method.

Figure 6B:
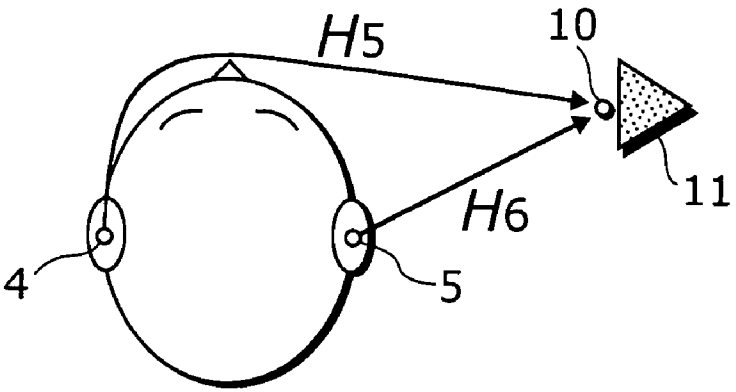
FIG. 6B is a diagram showing a calculation model for calculating transfer functions from the position of a target sound image to the entrances to the respective ear canals.
Figure 6A:
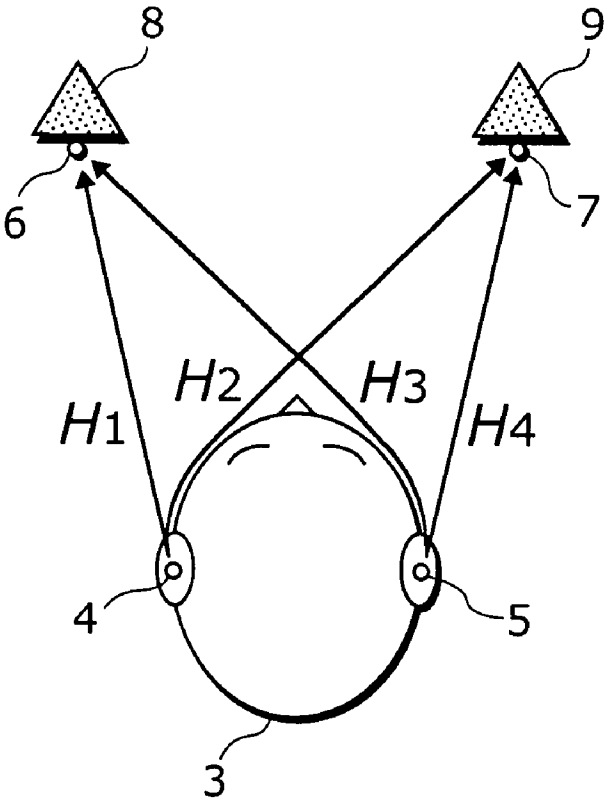
FIG. 6A is a diagram showing a calculation model for calculating transfer functions from the positions of acoustic transducers to the entrances to the respective ear canals.

The following provides more concrete descriptions of a method for calculating HRTFs. FIG. 6A shows a calculation model for calculating HRTFs from the positions of acoustic transducers to the entrances to the respective ear canals, and FIG. 6B shows a calculation model for calculating HRTFs from the position of a target sound image to the entrances to the respective ear canals. The head model 3 in FIG. 6 is the same as the head model shown in FIG. 3B. A sound emitting point 4 indicates the sound emitting point defined at the entrance to the left ear canal of the head model 3, and a sound emitting point 5 indicates the sound emitting point defined at the entrance to the right ear canal of the head model 3. A sound receiving point 6 and a sound receiving point 7 are sound receiving points such as microphones that are defined at an acoustic transducer 8 and an acoustic transducer 9 placed in the vicinity of the head model 3. The acoustic transducer 8 and the sound receiving point 6 are located near the left ear canal of the head model 3, whereas the acoustic transducer 9 and the sound receiving point 7 are located near the right ear canal of the head model 3. In FIG. 6A, a transfer function from the sound emitting point 4 to the sound receiving point 6 is H1, a transfer function from the sound emitting point 4 to the sound receiving point 7 is H3, a transfer function from the sound emitting point 5 to the sound receiving point 7 is H2, and a transfer function from the sound emitting point 5 to the sound receiving point 7 is H4. In FIG. 6B, a sound receiving point 10 is a sound receiving point defined at a target sound source 11 being a virtual acoustic transducer. A transfer function from the sound emitting point 4 to the sound receiving point 10 is H5, and a transfer function from the sound emitting point 5 to the sound receiving point 10 is H6.

Here, stationary analysis of the boundary element method is performed by under the definition that a sound with a stationary frequency is radiated independently from each of the sound emitting points 4 and 5. More specifically, potentials on an interface of the head model 3 resulted from the acoustic radiation from each sound emitting point are determined, and then the sound pressure at an arbitrary point in the space is determined from such potentials as an external problem. By once calculating the potential at each nodal point on the interface of the head model resulted from the acoustic radiation from the sound emitting point 4 in FIG. 6 on a stationary frequency basis, it is possible to determine the sound pressures at the sound receiving point 6, the sound receiving point 7, and the sound receiving point 10 by combining the sound pressures at the respective nodal points. The sound pressures at the sound receiving point 6, the sound receiving point 7, and the sound receiving point 10 resulted from the acoustic radiation from the sound emitting point 5 can be determined in the same manner.

The number of nodal points on the head model 3 of the first embodiment is 15052, and it has turned out that the time required for calculations by means of combining sound pressures at the respective nodal points is about one thousandth compared with the time required for calculating potentials. Here, by defining that the sound pressure at the sound emitting point 4 is "1" in amplitude and "0" in phase, the sound pressure at the sound emitting point 6 serves as a transfer function, and H1 is determined. Similarly, the transfer function H3 and the transfer function H5 are determined from the sound pressures at the sound receiving point 7 and the sound receiving point 10. Furthermore, the sound pressure at the sound emitting point 5 is defined in the same manner, and the transfer function H2, the transfer function 4, and the transfer function H6 are determined from the sound pressures at the sound receiving point 6, the sound receiving point 7 and the sound receiving point 10.

Figure 7:
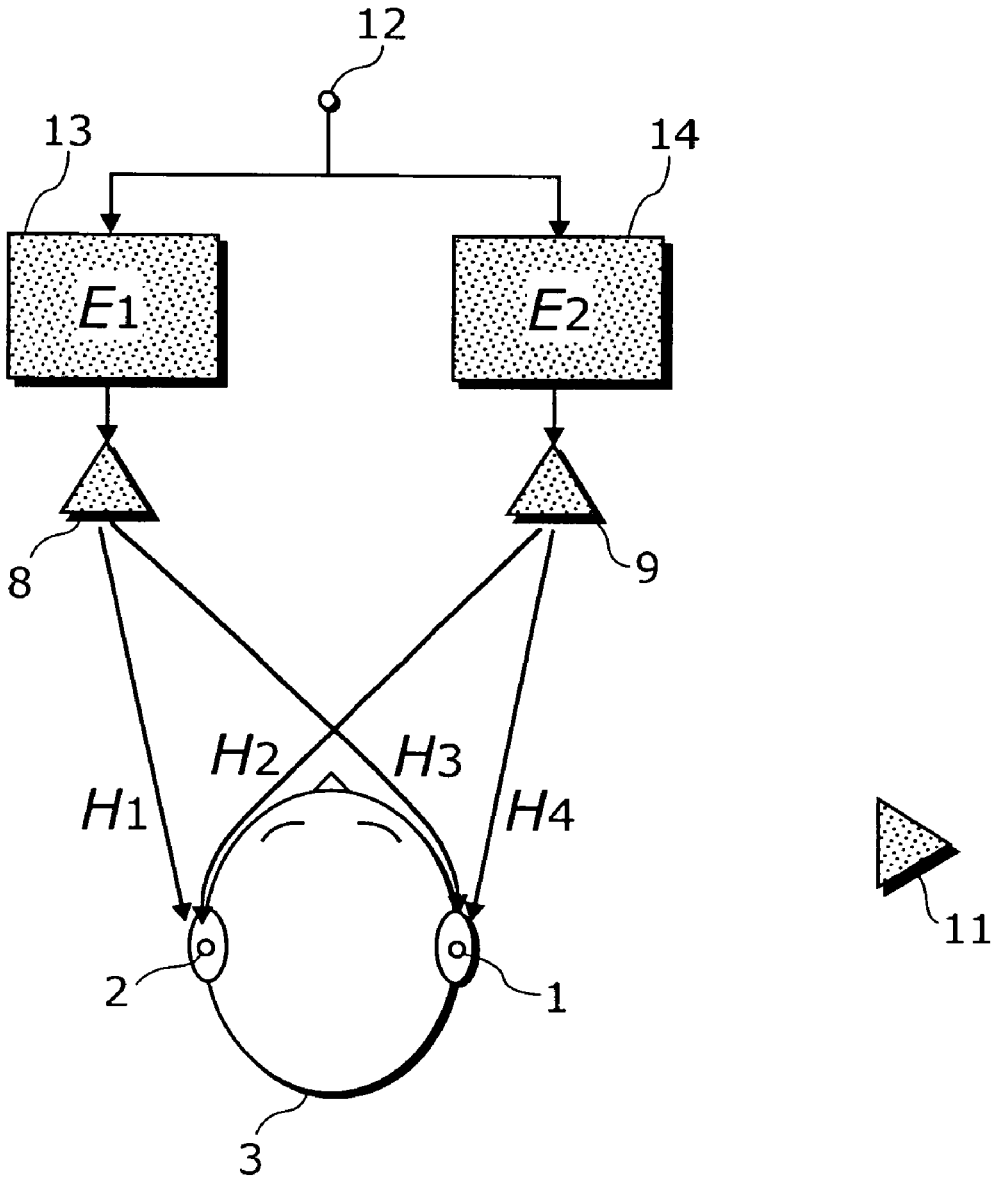
FIG. 7 is a basic block diagram showing the sound image control device that uses correction filters.

FIG. 7 is a basic block diagram showing the sound image control device that uses correction filters. In FIG. 7, the sound image of the target sound source 11 is achieved by performing filtering in the acoustic transducer 8 and acoustic transducer 9 using a correction filter 13 and a correction filter 14. Supposing that the characteristics of the correction filter 13 is E1 and the characteristics of the correction filter 14 is E2, the following Equation 1 is satisfied under the condition that transfer functions from an input terminal 12 to the entrances to the respective ear canals are equal to transfer functions from the target sound source 11:

$$\begin{bmatrix} H_5 \\ H_6 \end{bmatrix} = \begin{bmatrix} H_1 & H_2 \\ H_3 & H_4 \end{bmatrix} \begin{bmatrix} E_1 \\ E_2 \end{bmatrix} \quad \text{<Equation 1>}$$

Thus, a characteristic function E1 and a characteristic function E2 are determined using the following Equation 2 that is obtained by modifying Equation 1:

$$\begin{bmatrix} E_1 \\ E_2 \end{bmatrix} = \begin{bmatrix} H_1 & H_2 \\ H_3 & H_4 \end{bmatrix}^{-1} \begin{bmatrix} H_5 \\ H_6 \end{bmatrix} \quad \text{<Equation 2>}$$

The transfer functions H1 to H6 are each a complex number in discrete frequencies obtained by numerical calculations. Thus, in order to use the characteristic function E1 and the characteristic function E2 in the frequency domain, a signal to the input terminal 12 is once transformed into the frequency domain through a fast Fourier transform (FFT) so as to multiply the resultant with the characteristic function E1 and the characteristic function E2, then an inverse fast Fourier transform (IFFT) is performed on the signal, and the resultant is outputted to the acoustic transducer 8 and the acoustic transducer 9 as time signals. Alternatively, it is also possible to realize the characteristic function E1 and the characteristic function E2 as filter characteristics in the time domain, using such a design approach for the time domain as disclosed in Japanese Patent No. 2548103 (hereinafter referred to as "Patent Document" 2) by first performing IFFT on the respective transfer functions H1 to H6 to transform them into responses in the time domain.

As described above, by realizing the correction filter 13 having the characteristic E1 and the correction filter 14 having the characteristic E2, it is possible to reliably localize the sound image of a signal to the input terminal 12 at the position of the target sound source 11.

Figure 8:
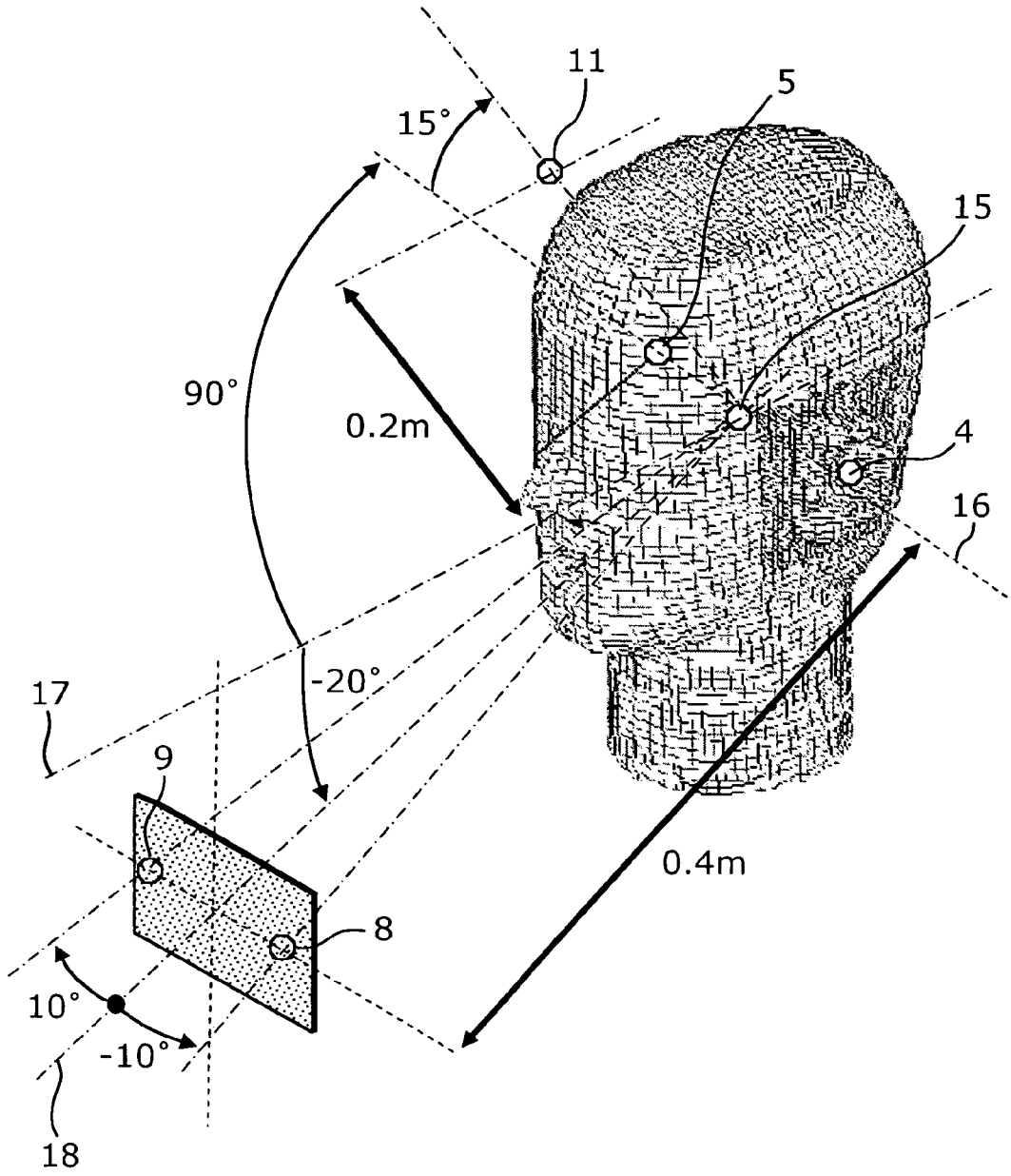
FIG. 8 is a diagram showing an example where a listener uses a portable device implemented with acoustic transducers for controlling sound images using the calculation method according to the first embodiment.
Figure 9A:
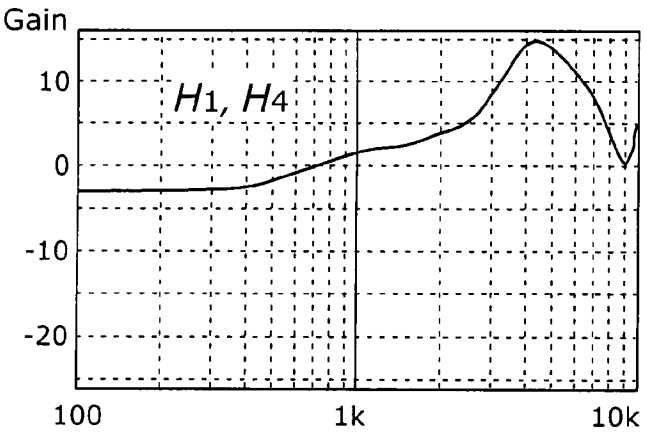
FIG. 9A is a graph showing the frequency characteristics of a transfer function H1 and a transfer function H4.
Figure 9B:
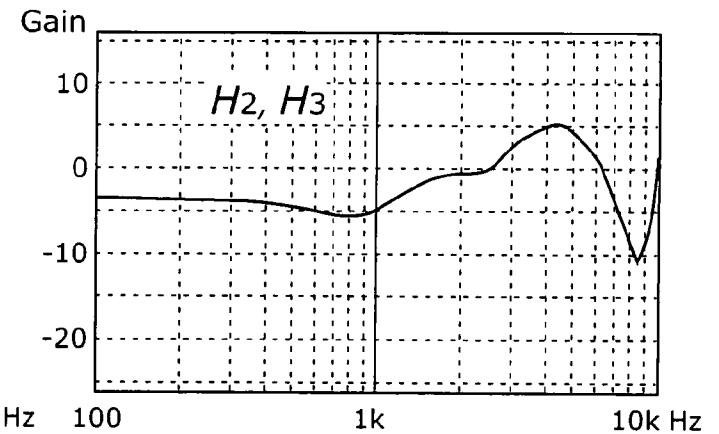
FIG. 9B is a graph showing the frequency characteristics of a transfer function H2 and a transfer function H3.
Figure 9C:
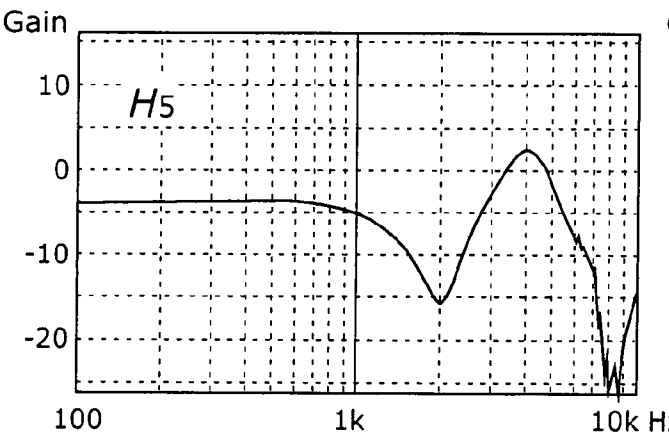
FIG. 9C is a graph showing the frequency characteristics of a transfer function H5.
Figure 9D:
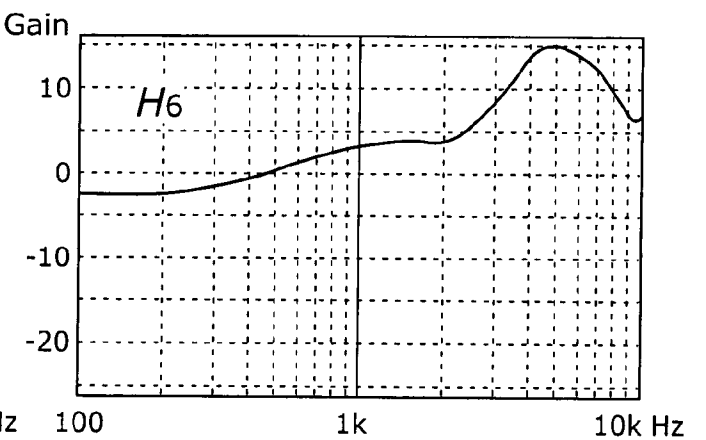
FIG. 9D is a graph showing the frequency characteristics of a transfer function H6.

FIG. 8 is a diagram showing an example where a listener uses a portable device implemented with acoustic transducers for controlling sound images using the calculation method according to the first embodiment. In this drawing, broken lines 16 indicate a straight line that connects the right and left ear canals, i.e., the sound emitting point 4 and the sound emitting point 5. Alternate long and short dashed lines 17 indicate a straight line that passes through a head center 15 and that indicates an azimuthal angle of 0 degrees. Alternate long and short dashed lines 18 indicate a straight line that connects the central point between the acoustic transducer 8 and the acoustic transducer 9 with the head center 15. Here, the acoustic transducer 8 is located at a position that is 0.4 m distant from the head center 15 and that is at an azimuthal angle of −10 degrees and at an elevation angle of −20 degrees with respect to the head center 15, and the acoustic transducer 9 is located at a position that is at an azimuthal angle of 10 degrees and at an elevation angle of −20 degrees with respect to the head center 15. Meanwhile, the target sound source 11 is located at a position that is at an azimuthal angle of 90 degrees and at an elevation angle of 15 degrees, and that is 0.2 distant from the head center 15.

FIG. 9 is a diagram showing example calculations that are performed under the condition shown in FIG. 8. In FIG. 8, since the acoustic transducer 8 and the acoustic transducer 9 are at an angle that is symmetric with respect to the head model 3, the transfer function H1 and the transfer function H4, and the transfer function H2 and the transfer function H3 have the same frequency characteristics, respectively. FIG. 9A is a graph showing the frequency characteristics of the transfer function H1 and the transfer function H4. FIG. 9B is a graph showing the frequency characteristics of the transfer function H2 and the transfer function H3. FIG. 9C is a graph showing the frequency characteristics of the transfer function H5. FIG. 9D is a graph showing the frequency characteristics of the transfer function H6.

Figure 10B:
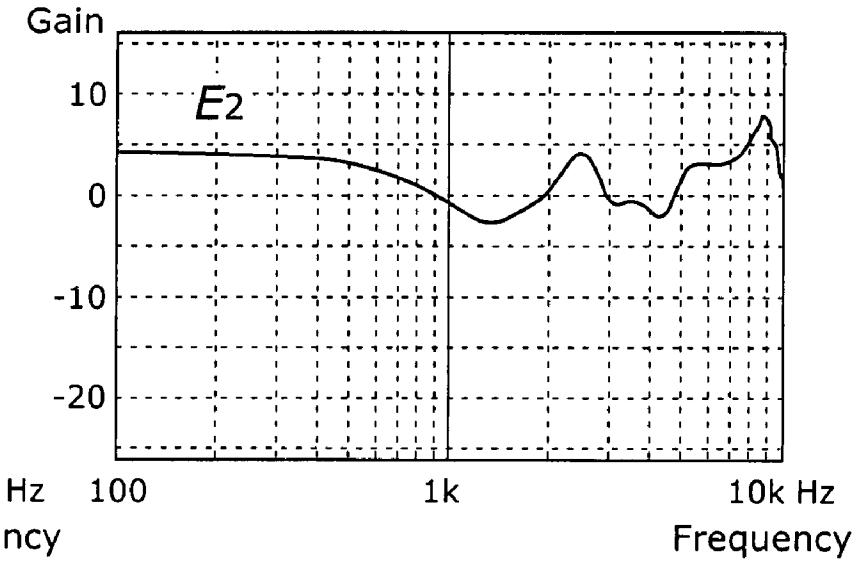
FIG. 10B is a graph showing the frequency characteristics of a characteristic function E2.
Figure 10A:
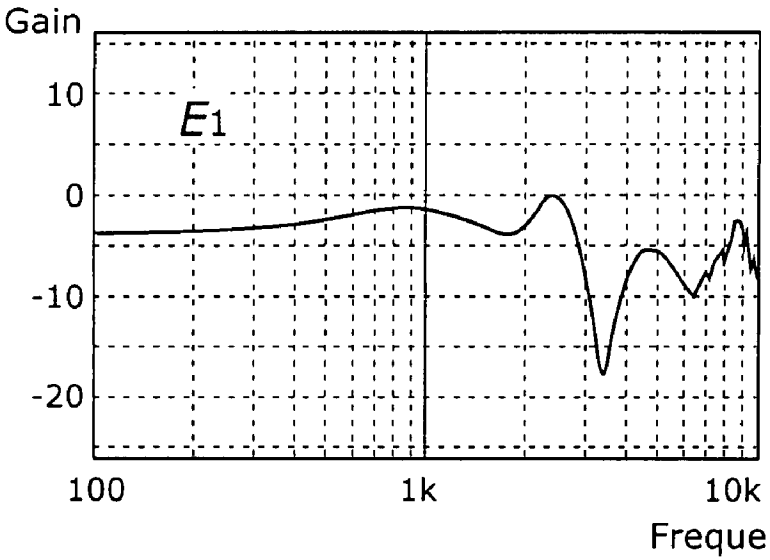
FIG. 10A is a graph showing the frequency characteristics of a characteristic function E1.

By applying, to Equation 2, the respective transfer functions H1 to H6 determined as shown in FIG. 9, it is possible to calculate the characteristic function E1 of the correction filter 13 and the characteristic function E2 of the correction filter 14. FIG. 10 graphically shows the frequency characteristics of the characteristic function E1 and the characteristic function E2 obtained from the transfer functions H1 to H6 obtained as shown in FIG. 9. FIG. 10A is a graph showing the frequency characteristics of the characteristic function E1. FIG. 10B is a graph showing the frequency characteristics of the characteristic function E2.

With the above structure, precise localization of sound images is obtained since it is possible for the listener to clearly perceive the sound image of the target sound source 11 even when the acoustic transducer 8 and the acoustic transducer 9 as well as the target sound source 11 are located close to his/her head. The above description has been given for the case where there is one target source and it is fixed, but it is possible to support plural target sound sources by providing a combination of the correction filter 13 and the correction filter 14 in number that is equivalent to the number of target sound sources. Furthermore, in the case where a sound source is moved, it is possible to support such case by switching the characteristics of correction filters according to directions and distances based on a path though which such sound sources are moved.

As described above, according to the first embodiment, even when plural azimuthal angles, elevation angles, and distances are set to the target sound source 11, it is possible to determine, in an extremely short time, transfer functions and the characteristics of correction filters by combining sound pressures at potentials resulting from the sound from sound emitting points at the entrances to the respective ear canals of the head model 3 since such potentials have been already calculated. Furthermore, using the numerical calculation that allows the size of a sound emitting point and a sound receiving point to be ignored, it is possible to determine transfer functions with high accuracy for even the case where a speaker and a microphone is located closely to the head, which is the case where the sound field would have been affected in a conventional transfer function measurement, as well as it is possible to calculate correction filter characteristics from such transfer functions. Accordingly, it is possible to control sound images in a correct manner.

Second Embodiment

The second embodiment describes the case where the sound image control device of the first embodiment is applied to sound listening using a headphone so as to obtain precise localization of sound images also in the case of sound listening using a headphone.

Figure 11:
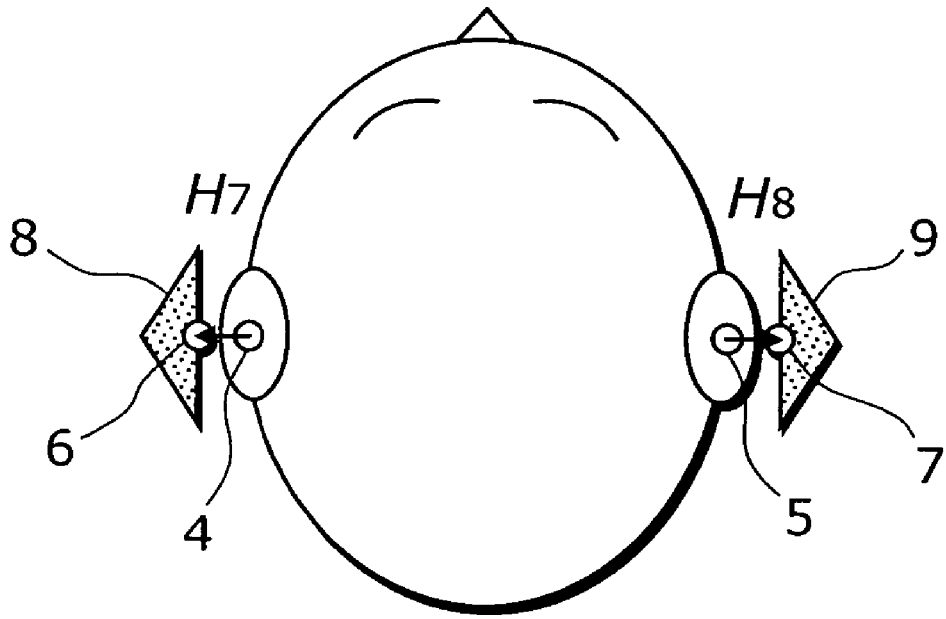
FIG. 11 is a diagram showing a calculation model for calculating transfer functions from acoustic transducers of a sound image control device of a second embodiment to the entrances to the respective ear canals.

FIG. 11 is a diagram showing a calculation model for calculating transfer functions from acoustic transducers of a sound image control device of the second embodiment to the entrances to the respective ear canals. In FIG. 11, the same constituent elements as those shown in FIG. 6 are assigned the same reference numbers, and descriptions thereof are not provided. FIG. 11 illustrates a calculation model corresponding to the one for a so-called headphone listening in which the acoustic transducer 8 and the acoustic transducer 9 are placed close to the respective ears of the head model 3. In other words, the sound emitting point 4 located at the left ear canal allows the sound pressure generated at the sound receiving point 7 at the acoustic transducer 9 to be ignored. Similarly, the sound emitting point 5 located at the right ear canal allows the sound pressure generated at the sound receiving point 6 at the acoustic transducer 8 to be ignored. Thus, as in the case of the first embodiment, the transfer function H7 from the acoustic transducer 8 is determined as the sound pressure at the sound receiving point 6. Also, the transfer function H8 from the acoustic transducer 9 is determined as the sound pressure at the sound receiving point 7.

Figure 12:
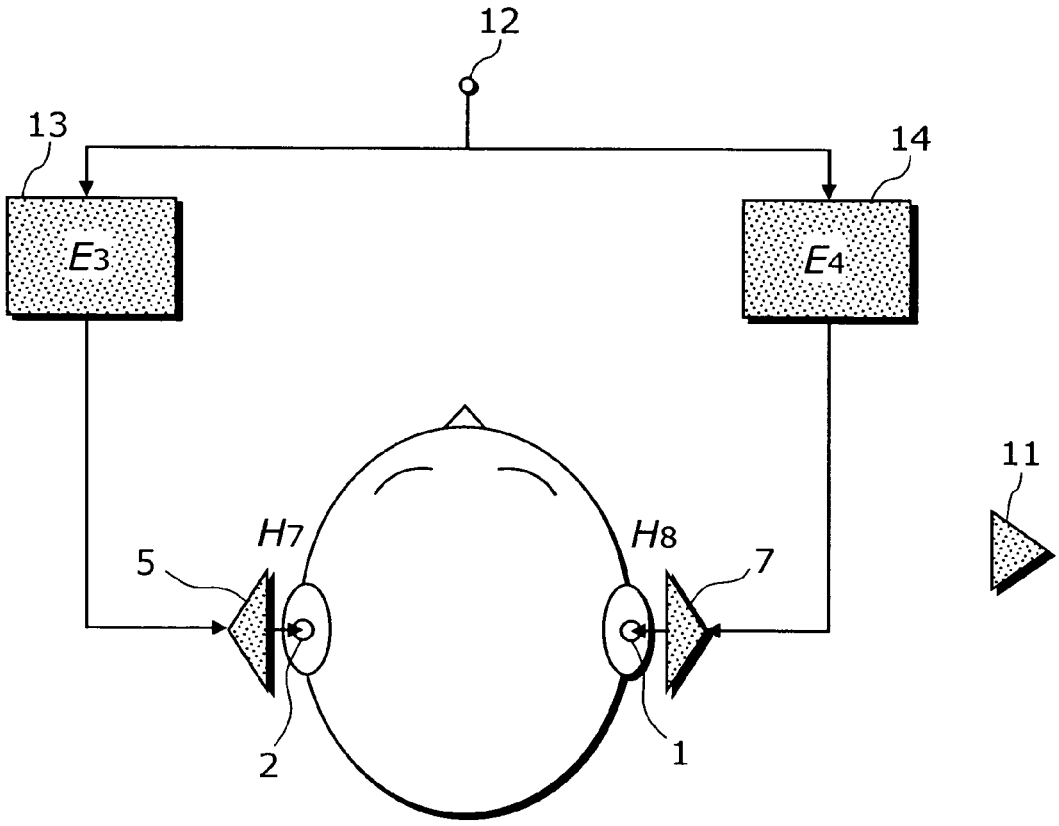
FIG. 12 is a diagram showing the basic block of the sound image control device using transfer functions that are obtained based on a relationship shown in FIG. 11.

FIG. 12 is a diagram showing the basic block of the sound image control device using transfer functions that are obtained based on a relationship shown in FIG. 11. In this drawing, the correction filter 13 and the correction filter 14 are correction filters for realizing the target sound source 11 using the acoustic transducer 8 and the acoustic transducer 9. Supposing that the characteristics of the correction filter 13 is E3 and the characteristics of the correction filter 14 is E4, the following Equation 3 is satisfied under the condition that transfer functions from the input terminal 12 to the entrances to the respective ear canals (the left ear canal entrance 1 and the right ear canal entrance 2) equal to the transfer functions from the target sound source 11 to the entrances to the respective ear canals (the left ear canal entrance 1 and the right ear canal entrance 2):

$$\begin{bmatrix} H_5 \\ H_6 \end{bmatrix} = \begin{bmatrix} H_7 \cdot E_3 \\ H_8 \cdot E_4 \end{bmatrix} \qquad \text{<Equation 3>}$$

Thus, a characteristic function E3 and a characteristic function E4 are determined using the following Equation 4 that is obtained by modifying Equation 3:

$$\begin{bmatrix} E_3 \\ E_4 \end{bmatrix} = \begin{bmatrix} \frac{H_5}{H_7} \\ \frac{H_6}{H_8} \end{bmatrix} \qquad \text{<Equation 4>}$$

With the above structure, it is possible to obtain precise localization of sound images at a location where the target sound source 11 is located in the case of sound listening using a headphone, by realizing, at the entrances to the respective ear canals of the listener, transfer functions from the target sound source 11.

Third Embodiment

The first and second embodiments describe the case where sound emitting points are placed at the entrances to the respective ear canals, but the third embodiment describes the case where more precise localization of sound images is achieved by placing sound emitting points at the respective eardrums so as to determine transfer functions to a target sound source.

Figure 13B:
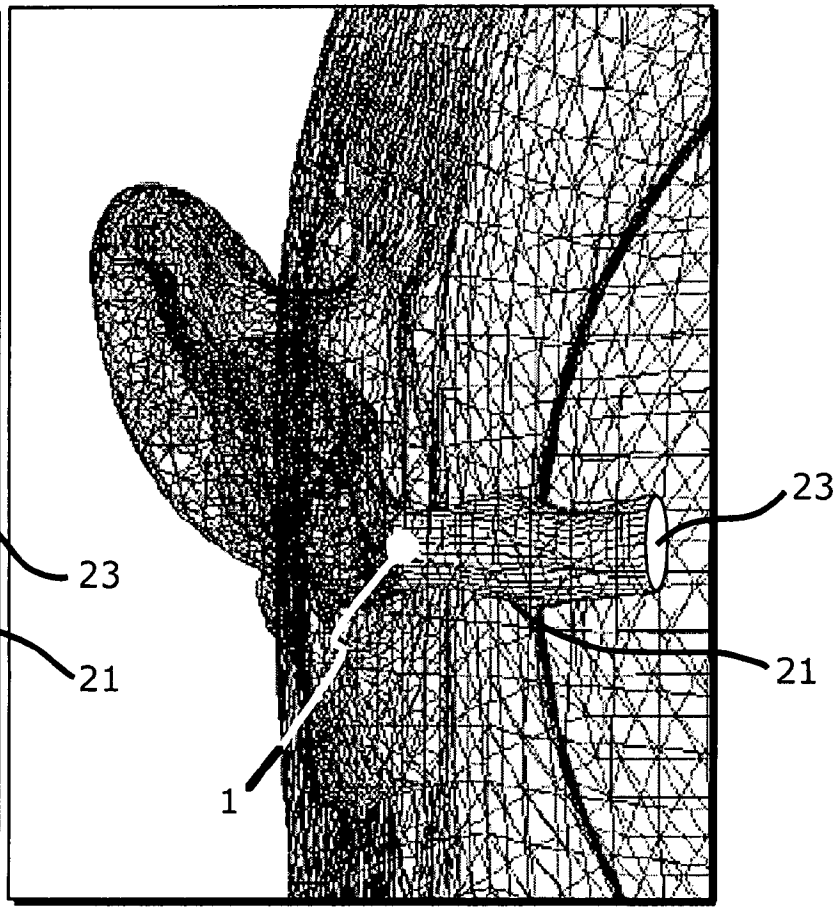
FIG. 13B is a top view showing the right pinna region of the head model 3.
Figure 13A:
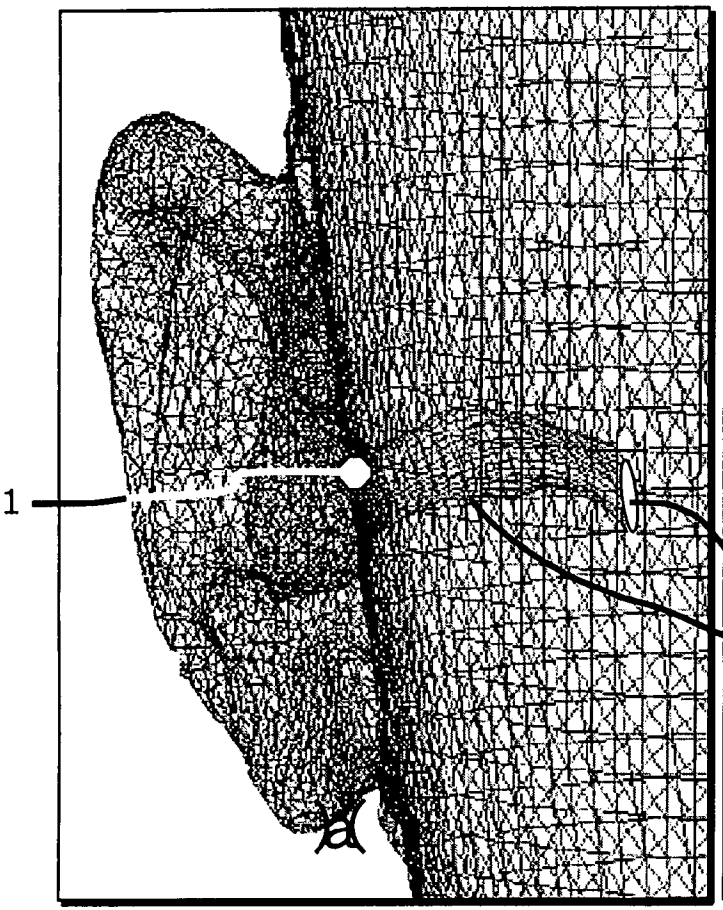
FIG. 13A is a front view showing the right pinna region of a head model 3.

FIG. 13 is a diagram showing a more detailed 3-D shape of the right pinna region of the head model 3. FIG. 13A is a front view showing the right pinna region of the head model 3, and FIG. 13B is a top view showing the right pinna region of the head model 3. As shown in these drawings, an eardrum 23 is formed on the ear canal 21 starting from the ear canal entrance 1. The third embodiment is the same as the first embodiment except that the ends of the respective ear canals of the head model 3 are closed by the eardrums.

Figure 14:
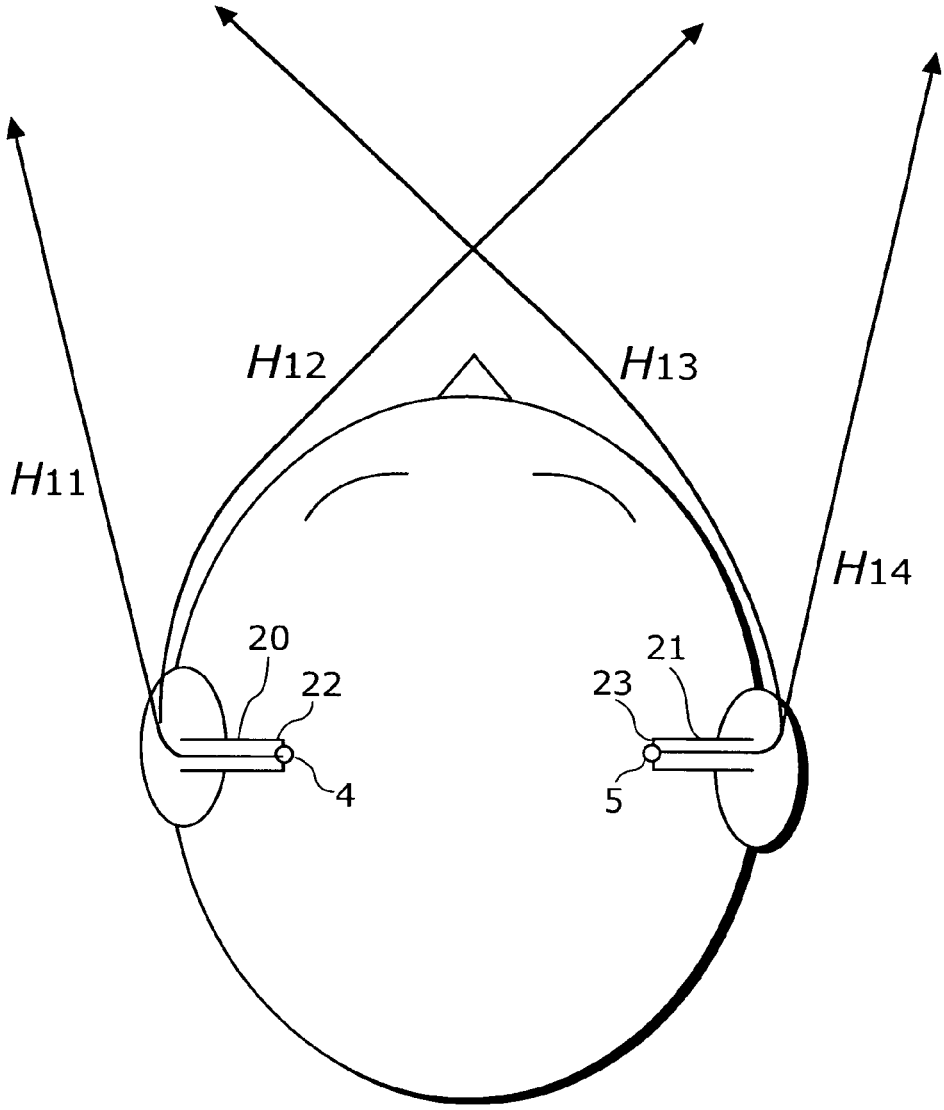
FIG. 14 is a diagram showing an example calculation model for calculating transfer functions from the acoustic transducers of the sound image control device to the eardrums, using the head model 3 shown in FIG. 13.

FIG. 14 is a diagram showing an example calculation model for calculating transfer functions from the acoustic transducers of the sound image control device to the eardrums, using the head model 3 shown in FIG. 13. In this drawing, an eardrum 22 is formed at the end of the left ear canal 20, and the sound emitting point 4 is defined on this eardrum 22. Also, an eardrum 23 is formed at the end of the right ear canal 21, and the sound emitting point 5 is defined on this eardrum 23. Here, transfer functions to the sound receiving point 6 and the sound receiving point 7 defined at the acoustic transducer 8 and the acoustic transducer 9 shown in FIG. 6A are calculated. Here, the transfer function from the sound emitting point 4 to the sound receiving point 6 is H11, the transfer function from the sound emitting point 4 to the sound receiving point 7 is H12, the transfer function from the sound emitting point 5 to the sound receiving point 6 is H13, and the transfer function from the sound emitting point 5 to the sound receiving point 7 is H14.

Figure 15:
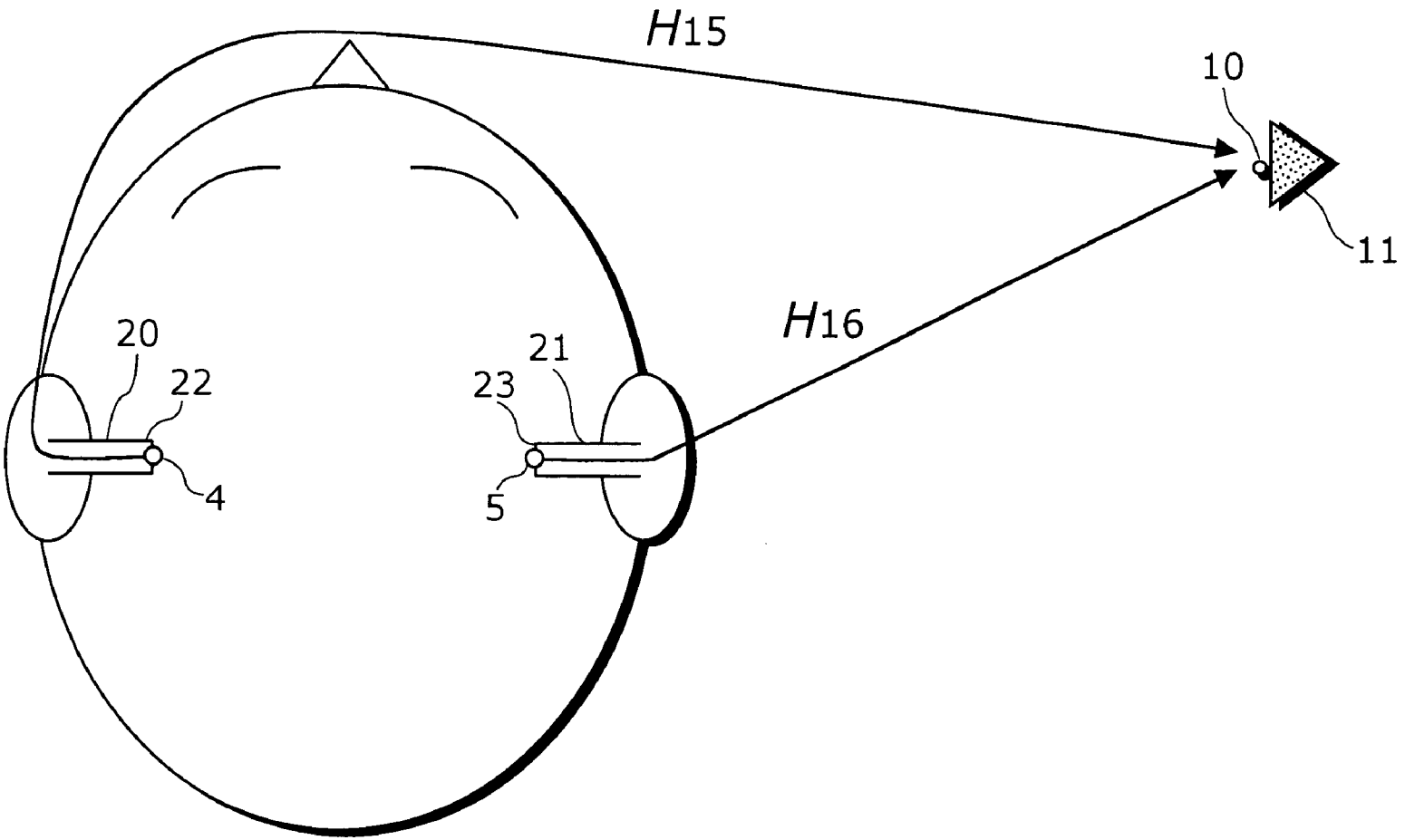
FIG. 15 is a diagram showing an example calculation model for calculating transfer functions from the respective eardrums to a sound receiving point 10 defined at a target sound source 11.

FIG. 15 is a diagram showing an example calculation model for calculating transfer functions from the respective eardrums to the sound receiving point 10 defined at the target sound source 11. As shown in this drawing, the transfer function from the sound emitting point 4 to the sound receiving point 10 is H15, and the transfer function from the sound emitting point 5 to the sound receiving point 10 is H16. These transfer functions H11 to H16 are obtained by combining the sound pressures of the already-calculated potentials at the nodal points.

Figure 16:
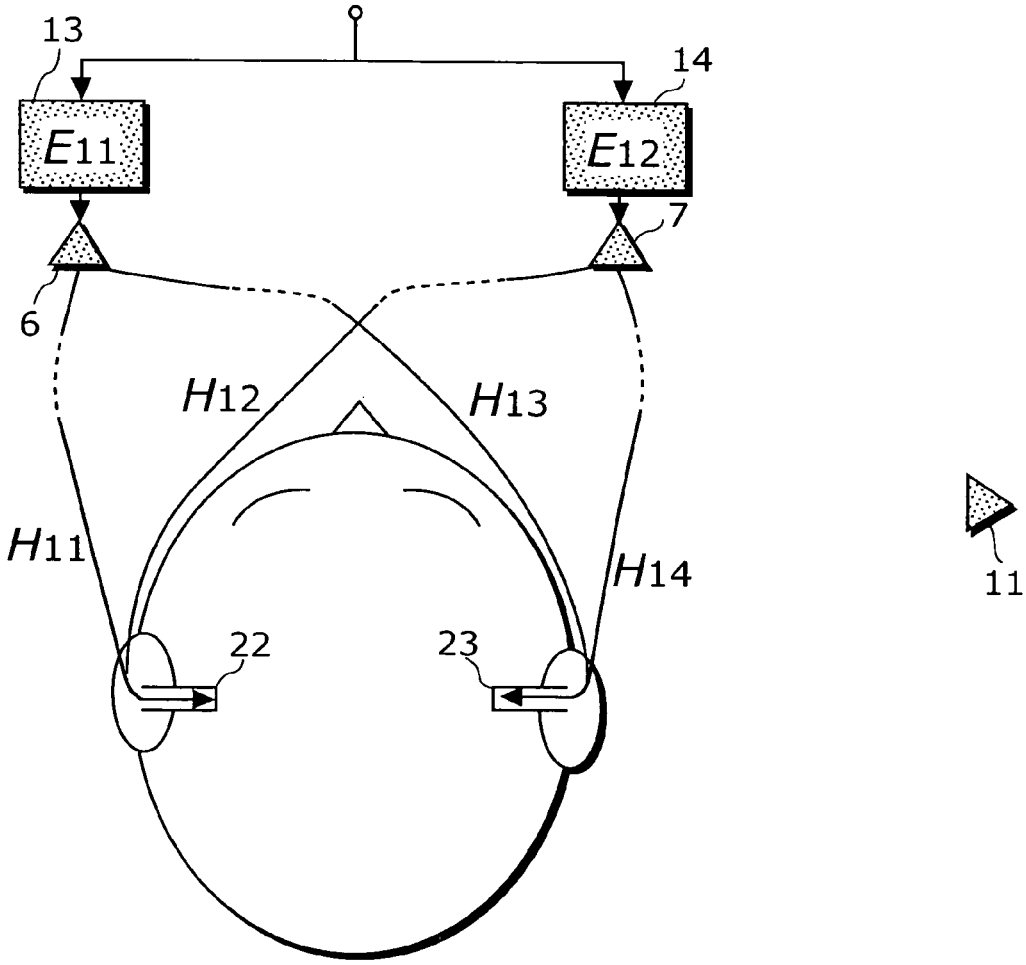
FIG. 16 is a diagram showing the basic block of the sound image control device using transfer functions H11 to H16 that are obtained based on relationships shown in FIG. 14 and FIG. 15.

FIG. 16 is a diagram showing the basic block of the sound image control device using transfer functions H11 to H16 that are obtained based on relationships shown in FIG. 14 and FIG. 15. Referring to this drawing, the characteristics of the correction filter 13 and the correction filter 14 are determined using the following Equation 5, supposing that their characteristics are the characteristics E11 and the characteristics E12, respectively:

$$\begin{bmatrix} E_{11} \\ E_{12} \end{bmatrix} = \begin{bmatrix} H_{11} & H_{12} \\ H_{13} & H_{14} \end{bmatrix}^{-1} \begin{bmatrix} H_{15} \\ H_{16} \end{bmatrix} \qquad \text{<Equation 5>}$$

With the above structure, it is possible to obtain more precise localization of sound images at the target sound source 11 by realizing transfer functions from the target sound source 11 to the respective eardrums of the listener.

Fourth Embodiment

The second embodiment describes the localization of sound images in the case of sound listening using a headphone by setting sound emitting points at the entrances to the respective ear canals of the head model 3. The fourth embodiment describes the localization of sound images in the case of sound listening using a headphone by defining sound emitting points on the eardrums of the head model 3.

Figure 17:
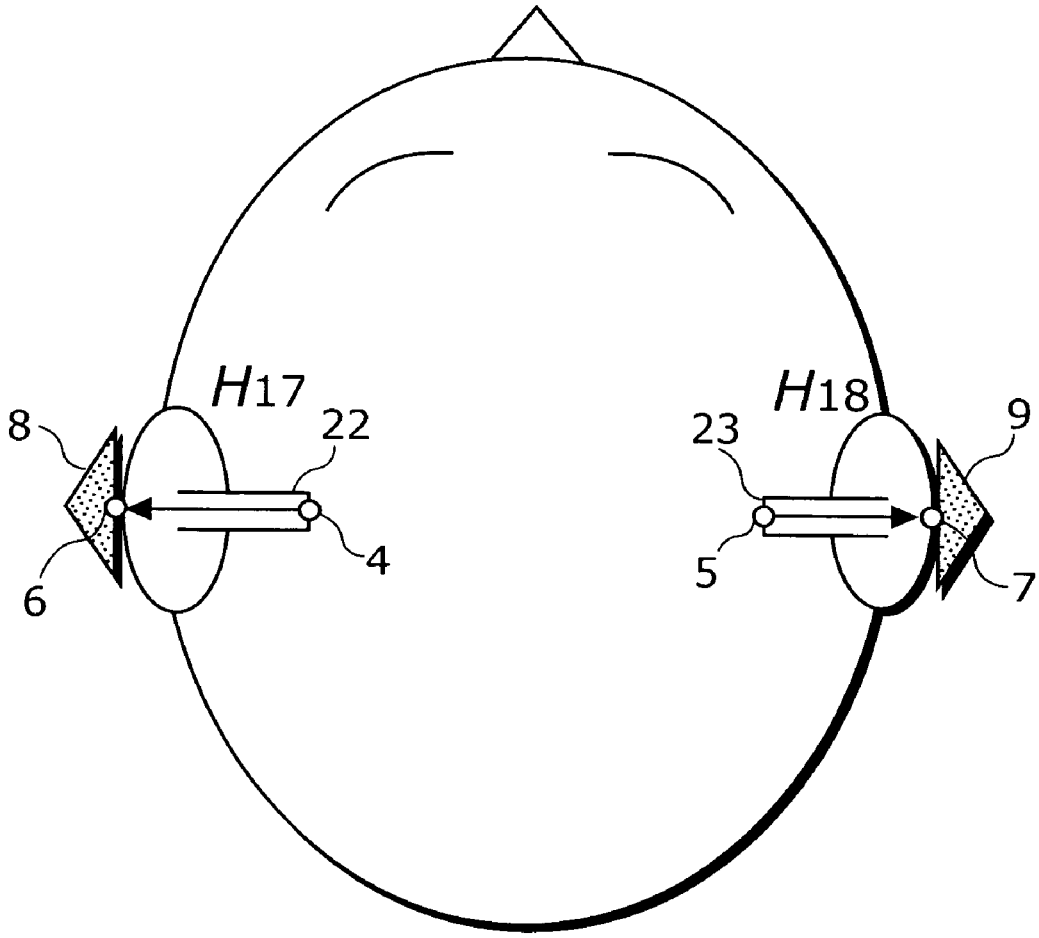
FIG. 17 is a diagram showing an example calculation model for calculating transfer functions from acoustic transducers of a sound image control device of a fourth embodiment to the respective eardrums.

FIG. 17 is a diagram showing an example calculation model for calculating transfer functions from acoustic transducers of a sound image control device of the fourth embodiment to the respective eardrums. In this drawing, the same constituent elements as those shown in FIG. 14 are assigned the same reference numbers, and descriptions thereof are not provided. FIG. 17 illustrates a calculation model corresponding to the one for a so-called headphone listening in which the acoustic transducer 8 and the acoustic transducer 9 are placed in the vicinity of the respective ears of the head model 3. Here, as in the case of the second embodiment, the transfer function from the sound emitting point 4 to the sound receiving point 6 on the acoustic transducer 8 is determined as the transfer function H17 that is the sound pressure at the sound receiving point 6. Also, the transfer function from the sound emitting point 5 to the sound receiving point 7 on the acoustic transducer 9 is determined as the transfer function H18 that is the sound pressure at the sound receiving point 7.

Figure 18:
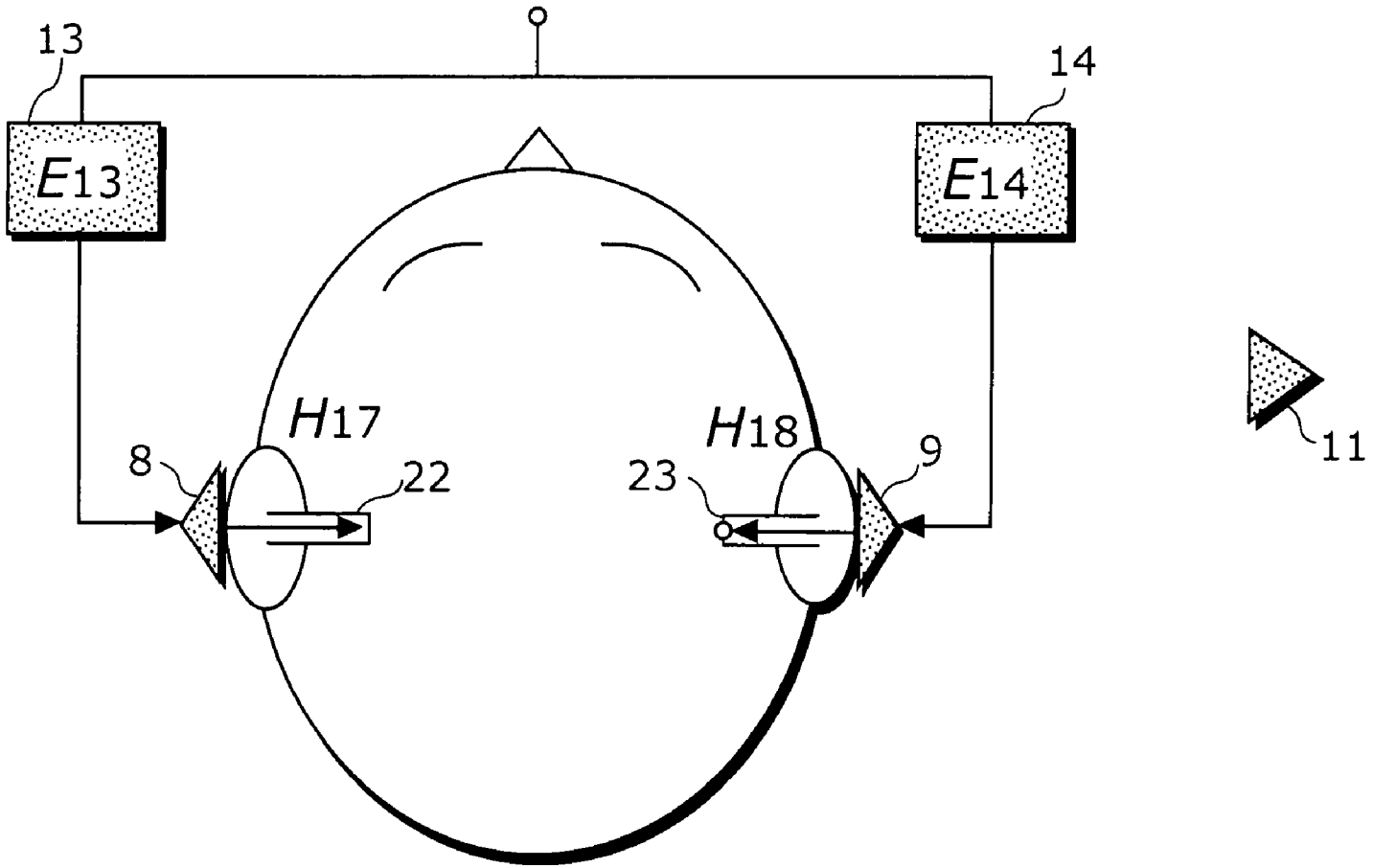
FIG. 18 is a diagram showing the basic block of the sound image control device using the transfer function H17 and the transfer function H18 that are obtained based on a relationship shown in FIG. 17 as well as the transfer function H15 and the transfer function H16.

FIG. 18 is a diagram showing the basic block of the sound image control device using the transfer function H17 and the transfer function H18 that are obtained based on a relationship shown in FIG. 17 as well as the transfer function H15 and the transfer function H16. Referring to this drawing, the characteristics of the correction filter 13 and the correction filter 14 are determined according to the following Equation 6, supposing that their characteristics are the characteristic function E13 and the characteristic function E14, respectively:

$$\begin{bmatrix} E_{13} \\ E_{14} \end{bmatrix} = \begin{bmatrix} \frac{H_{15}}{H_{17}} \\ \frac{H_{16}}{H_{18}} \end{bmatrix} \quad \text{<Equation 6>}$$

With the above structure, sound images are precisely localized at the target sound source since it is possible to calculate transfer functions from the respective eardrums of the listener to the target sound source 11 also in the case of headphone listening.

Fifth Embodiment

The fifth embodiment describes the sound image control device that reduces a difference in the effect of sound image localization among listeners from a parent population by modifying the head dimensions of a head model used to calculate transfer functions to the average dimensions of the heads of the listeners from such parent population to which the sound image control device is provided.

The dummy head of the head model 3 used in the first to fourth embodiments is created according to predetermined sizes and shapes, and the size of such dummy head, as well as the shapes of various parts of the head model such as ear shape, ear length, tragus distance, and face length are stored as data of the respective nodal points. Thus, transfer functions that are calculated using such a head model reflect the shapes of various parts of the head model.

Figure 19B:
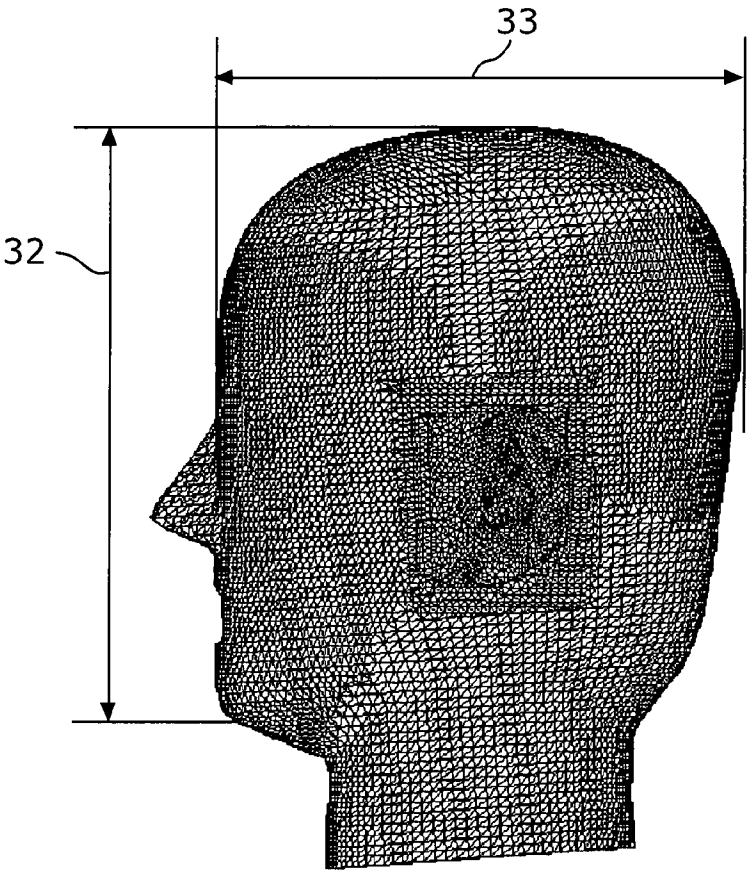
FIG. 19B is a side view of the head model 30.
Figure 19A:
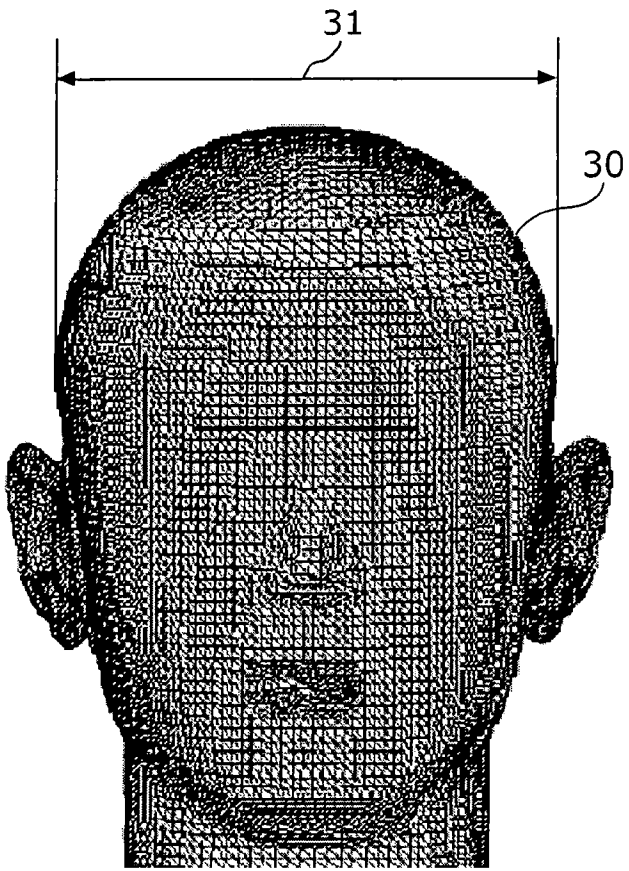
FIG. 19A is a front view of a head model 30 used to calculate transfer functions in a sound image control device of a fifth embodiment.
Figure 31:
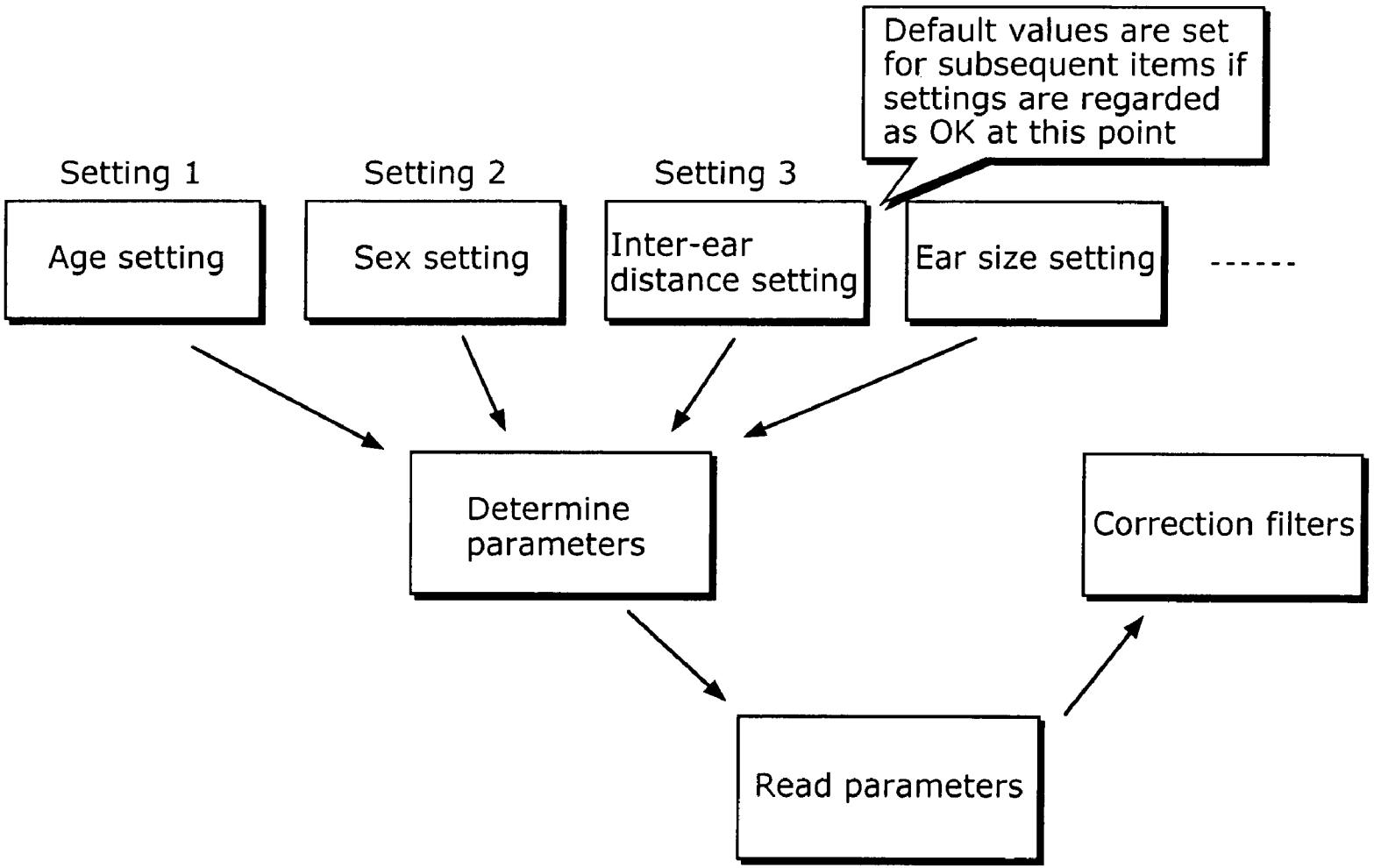
FIG. 31 is a diagram showing an example procedure taken by the sound image control device equipped with the setting input unit shown in FIG. 30 in the case where the listener performs an input for the setting while listening to the sound from a speaker.

FIG. 19A is a front view of a head model 30 used to calculate transfer functions in the sound image control device of the fifth embodiment, and FIG. 19B is a side view of the head model 30. In FIG. 19A, 31 indicates the width of the head, 32 indicates the height of the head, and 33 indicates the depth of the head. Here, suppose that the head width of the dummy head shown in FIG. 3A is Wd, the head height is Hd, and the head depth is Dd. Also, suppose that the average values of the heads belonging to the parent population to which the sound image control device of the present embodiment is provided are calculated from their statistical data, and the resultant is the head width of Wa, the head height of Ha, and the head depth of Da, respectively.

The head model on the calculator shown in FIG. 3B is deformed by modifying its dimensions according to the following proportion: the head width is Wa/Wd, the head height is Ha/Hd, and the head depth is Da/Dd. In other words, even when the first measured dimensions of the dummy head deviate from the average values of the dimensions of the heads belonging to the parent population to which the present sound image control device is provided, it is possible to realize, on a computer, a head model with the average head dimension values of the parent population by performing the above deformation (hereinafter referred to as "morphing processing").

By determining each transfer function by a numerical calculation, using the head model 30 deformed in the above manner, and by determining the characteristics E1*a* and the characteristics E2*a* as in the case of the first embodiment, it is possible to minimize a difference in the effect of sound image control among listeners belonging to a parent population to which the present sound image control device is provided.

Note, however, that in the case where morphing processing as described above has been performed on the head model, it is necessary to calculate potentials at the respective nodal points again. However, by previously performing re-calculations of the potentials at the respective nodal points and storing the resultant potentials of the respective nodal points into a memory or the like, it is easy to calculate transfer functions and to calculate the characteristics of the correction filters used to realize a target sound source.

Figure 20:
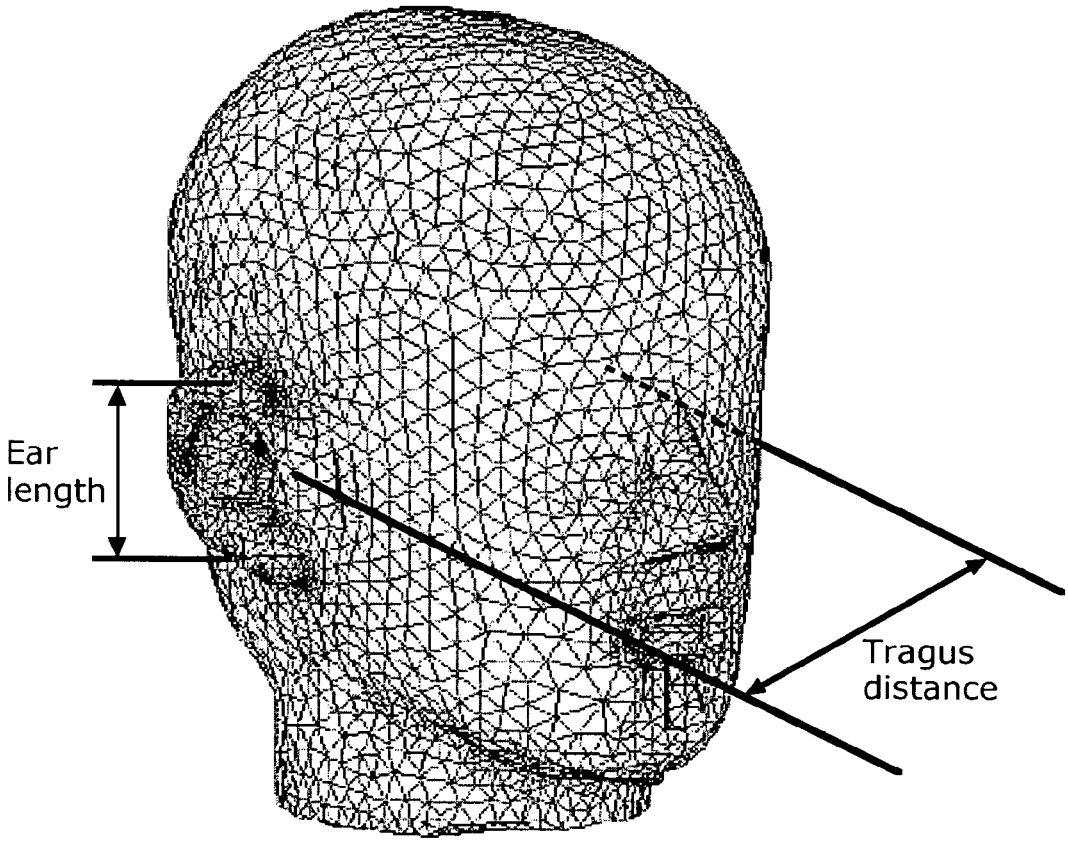
FIG. 20 is a perspective view showing the size of another part of the head model.

Note that the above description has been given for the case where the width, height, depth, or the like of the head are modified according to their average values obtained from the statistical data about the heads from a parent population, but the present invention is not necessarily limited to this. FIG. 20 is a perspective view showing the size of another part of the head model. As shown in this drawing, for example, the sizes of the dummy head, such as the ear length and the tragus distance, may be modified according to the proportion of the first-measured dimensions of the dummy head to the average dimension values of the heads from a parent population. Furthermore, the head width 31 may be a tragus distance, the head height 32 may be a total head height, and the head depth 33 may be a head length.

Sixth Embodiment

The sixth embodiment describes the case where a difference in the effect of sound image localization among listeners from a parent population is reduced by modifying the head dimensions of a head model used to calculate transfer functions to the average dimensions of the heads of listeners in a specific category in such parent population to which the sound image control device is provided and then by allowing a listener to select such specific category.

Figure 21:
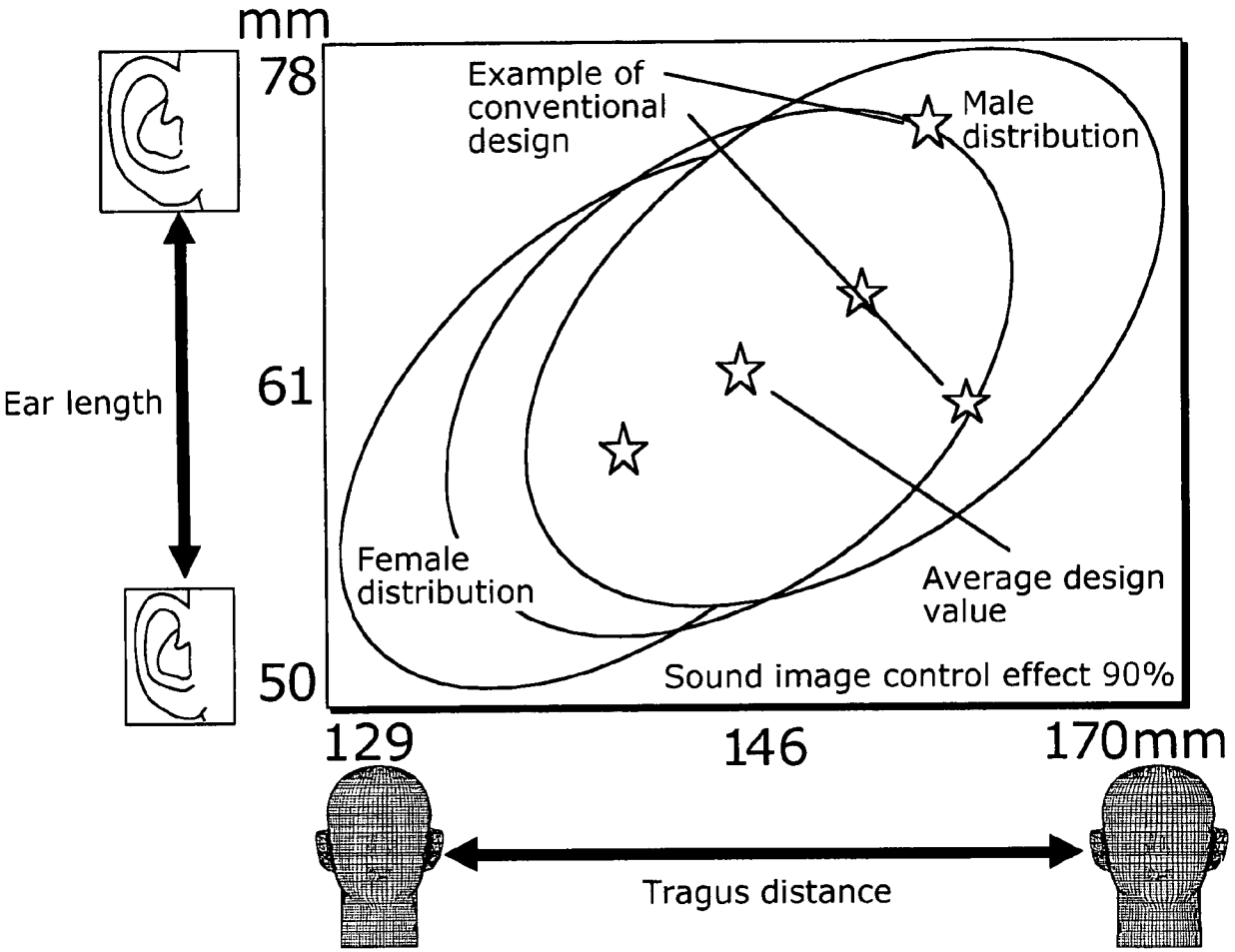
FIG. 21 is a graph showing variations in ear length and tragus distance between male and female.

FIG. 21 is a graph showing variations in ear length and tragus distance between male and female. As shown in this drawing, the tragus distance of male is about 130 mm to 170 mm, whereas that of female is about 129 mm to 158 mm. Meanwhile, the ear length of male is about 53 mm to 78 mm, whereas that of female is about 50 mm to 70 mm. For this reason, many sound image control devices are designed by use of values at positions indicated by stars in the drawing, but the use of average design values produces the sound image control effect of only about 90%.

FIG. 22 is a table showing specific categories in the parent population to which the sound image control device of the sixth embodiment is provided. In FIG. 22, the head model 35 is the male average in the parent population, where the head width is Wm, the head height is Hm, and the head depth is Dm. The head model 36 is the female average in the parent population, where the head width is Ww, the head height is Hw, and the head depth is Dw. The head model 37 is the average of a young age group (e.g., children aged from 7 to 15) in the parent population, where the head width is Wc, the head height is Hc, and the head depth is Dc.

Here, as in the case of the fifth embodiment, in the case where the dimensions of the head model 3 of the dummy head shown in FIG. 3A are the head width Wd, head height Hd, and head depth Dd, the head model 35 is deformed according to the following proportion to the head model 3: the head width is Wm/Wd, the head height is Hm/Hd, and the head depth is Dm/Dd. The head model 36 is deformed according to the following proportion to the head model 3: the head width is Ww/Wd, the head height is Hw/Hd, and the head depth is Dw/Dd. The head model 37 is deformed according to the following proportion to the head model 3: the head width is Wc/Wd, the head height is Hc/Hd, and the head depth is Dc/Dd.

Figure 23:
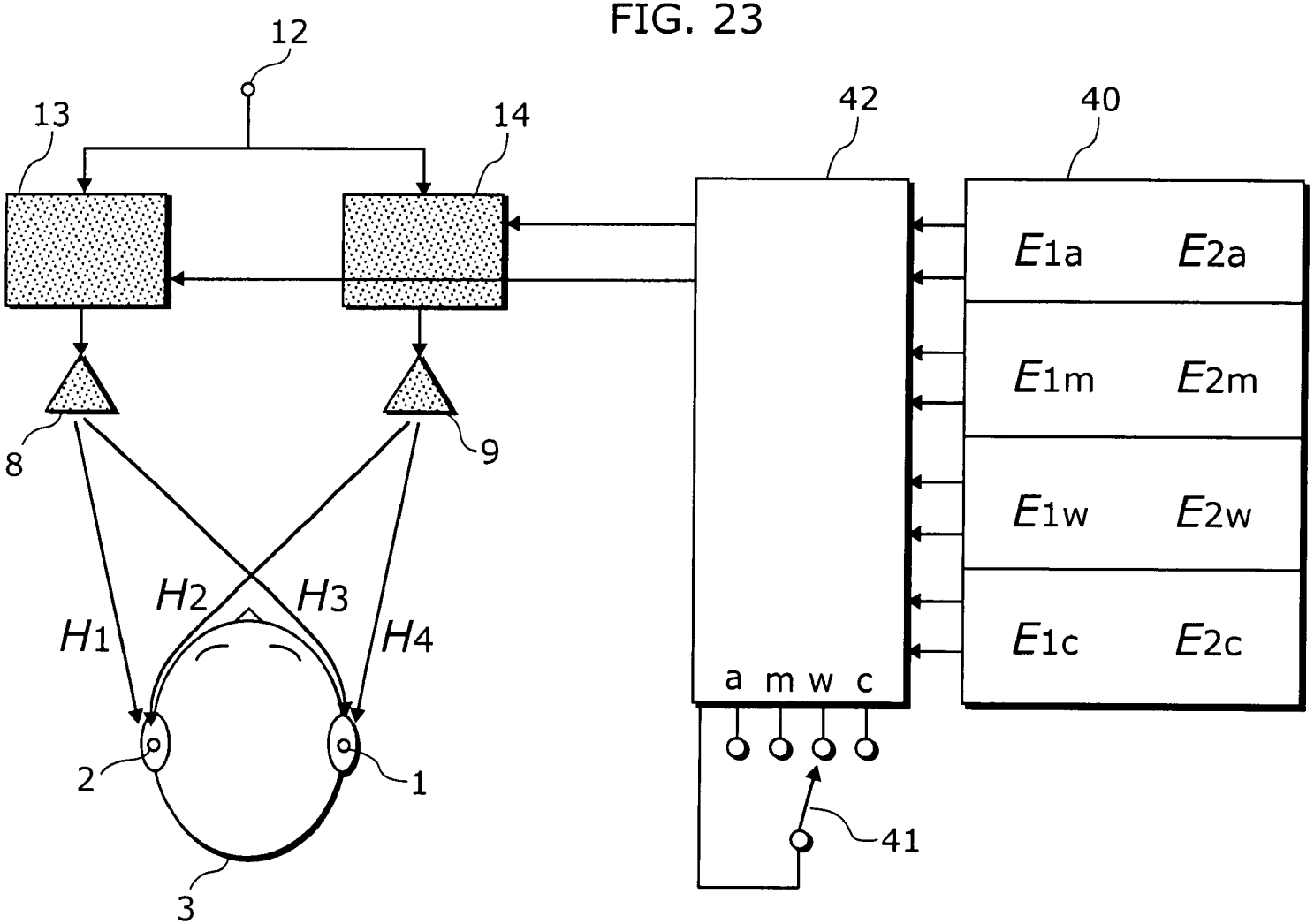
FIG. 23 is a block diagram showing a structure in which correction filter characteristics are switched according to the average values and specific categories of the parent population.

Using the head model 35, head model 36, and head model 37 deformed in the above manner, each transfer function is determined by a numerical calculation, and the characteristics Elm, characteristics E2*m*, characteristics E1*w*, characteristics E2*w*, characteristics E1*c*, and characteristics E2*c* of the correction filters are determined as in the case of the first embodiment. FIG. 23 is a block diagram showing a structure in which correction filter characteristics are switched according to the average values and specific categories of the parent population. In FIG. 23, the sound image control device newly includes: a characteristic storage memory 40 that stores the correction filter characteristics for the average values and the respective specific categories of the parent population; a switch 41 for selecting one of the average value a of the parent population, the specific category (male) m, the specific category (female) w, and the specific category (children); and a filter setting unit 42 that selects correction filter characteristics from the characteristic storage memory 40 according to the state of the switch 41, and sets the selected correction filter characteristics to the correction filter 13 and the correction filter 14. With this structure, in the case where the switch 41 selects "a" indicating the average of the parent population, the correction characteristics E1*a* and E2*a* being the correction characteristics for the average, are set to the correction filter 13 and the correction filter 14. In the case where the switch 41 selects "m" indicating the specific category (male), the correction characteristics E1*m* and E2*m* being the correction characteristics for male, are set to the correction filter 13 and the correction filter 14. Similarly, in the case where the switch 41 selects "w" indicating the specific category (female), the correction characteristics E1*w* and E2*w* being the correction characteristics for female, are set, and in the case where the switch 41 selects "c" indicating the specific category (children), the correction characteristics E1*c* and E2*c* being the correction characteristics for children, are set to the correction filter 13 and the correction filter 14, respectively. By a listener selecting filters appropriate for him/her from among these four types, it is possible to minimize a difference in the effect of sound image control among listeners.

Seventh Embodiment

The seventh embodiment describes the case where a difference in the effect of sound image localization among listeners from a parent population is reduced by previously modifying the head dimensions of head models used to calculate transfer functions according to the dimensions of the heads of the listeners from specific categories in such parent population to which the sound image control device is provided and then allowing a listener to select a specific category to which s/he belongs.

FIG. 24 shows specific categories in the parent population to which the sound image control device of the seventh embodiment is provided. According the specific categories of the seventh embodiment, head models are categorized into three groups depending on their head width. FIG. 24A is a table showing an example of head models M51 to M59 categorized into the group with the head width w1. FIG. 24B is a table showing an example of head models M61 to M69 categorized into the group with the head width w2. FIG. 24C is a table showing an example of head models M71 to M79 categorized into the group with the head width w3. In FIG. 24A, the head models with the head width of w1 are further categorized into nine types according to the head heights h1, h2, and h3 and to the head depths d1, d2, and d3. In FIG. 24B, the head models with the head width of w2 are categorized into nine types according to the above three head heights and to the above three head depths. In FIG. 24C, the head models with the head width of w3 are categorized into nine types in the similar manner. Here, in the present embodiment, using the head models M51 to M79 that are obtained by previously modifying the dimensions of the head model 3 according to the dimensions shown in FIGS. 24 A to 24C, each transfer function is determined by a numerical calculation, and correction filter characteristics E1-51, E2-51, . . . , E1-79, and E2-79 are determined, as in the case of the sixth embodiment.

Figure 25:
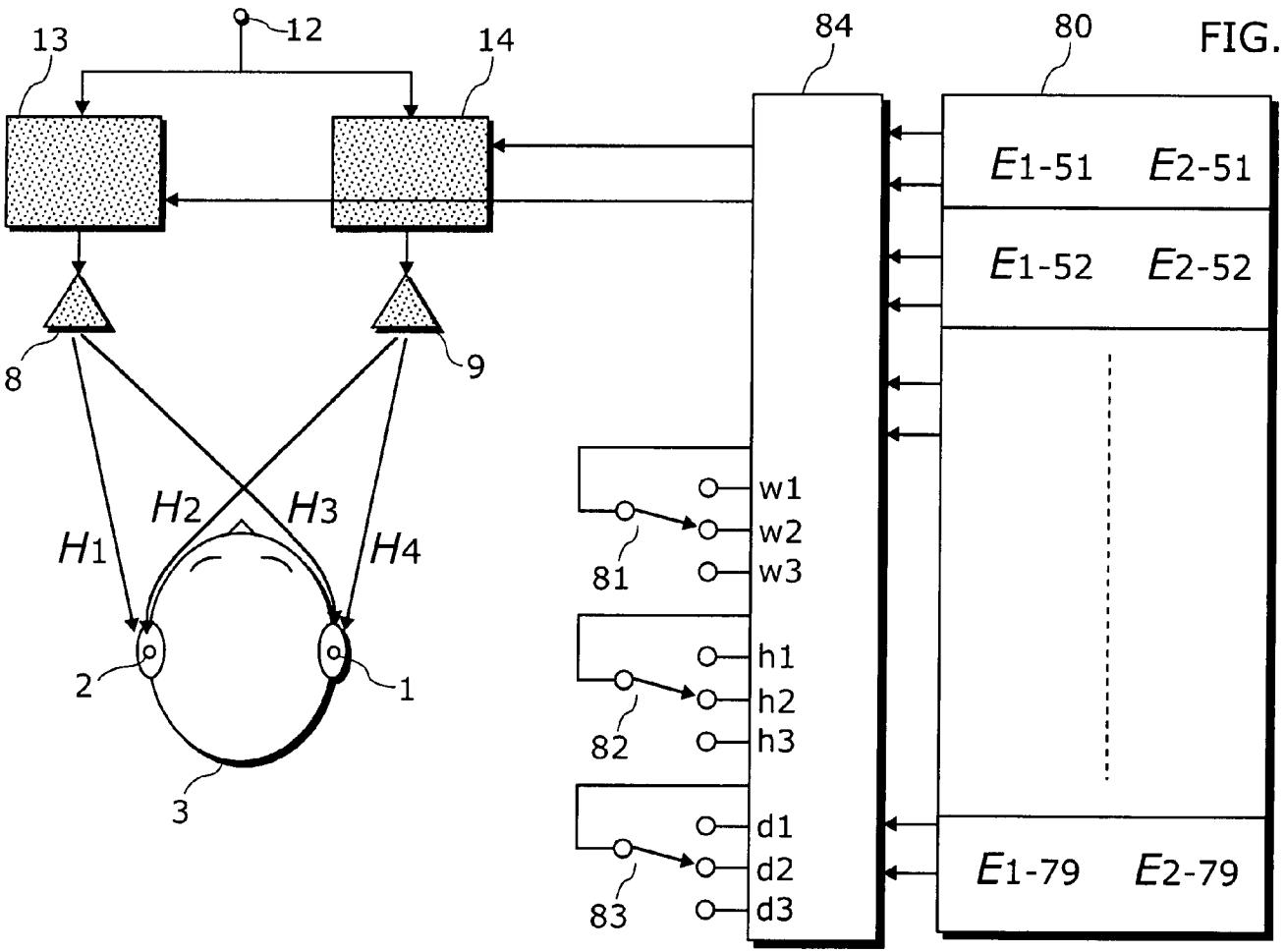
FIG. 25 is a block diagram showing a structure in which correction filter characteristics for head models are switched according to the specific categories categorized into 27 types as shown in FIGS. 24A to 24C.

FIG. 25 is a block diagram showing a structure in which correction filter characteristics for head models are switched according to the specific categories categorized into 27 types as shown in FIGS. 24A to 24C. In FIG. 25, the sound image control device includes: a characteristic storage memory 80 that stores the correction filter characteristics E1-51, E2-51, . . . , E1-79, and E2-79 that are calculated for the 27 head models shown in FIGS. 24A to 24C; a switch 81 for switching correction filters depending on which one of the three head widths it applies to; a switch 82 for switching correction filters depending on which one of the three head heights it applies to; a switch 83 for switching correction filters depending on which one of the three head depths it applies to; and a filter setting unit 84 that selects correction filter characteristics from the characteristic storage memory 80 according to the respective states of the switch 81, switch 82, and switch 83, and sets the selected correction filter characteristics to the correction filter 13 and the correction filter 14. By a listener selecting optimum filters for him/her based on a combination of the states of the switch 81, switch 82, and switch 83, it is possible to reduce a difference in the effect of sound image control among listeners attributable to the head dimensions of the listener.

Eighth Embodiment

The eighth embodiment describes the case where a difference in the effect of sound image localization among listeners from a parent population is reduced by modifying the size of the pinna region of the head model used to calculate transfer functions according to the sizes of pinna regions of the listeners in specific categories in such parent population to which the sound image control device is provided and then allowing a listener to select an appropriate specific category for him/her.

Figure 26B:
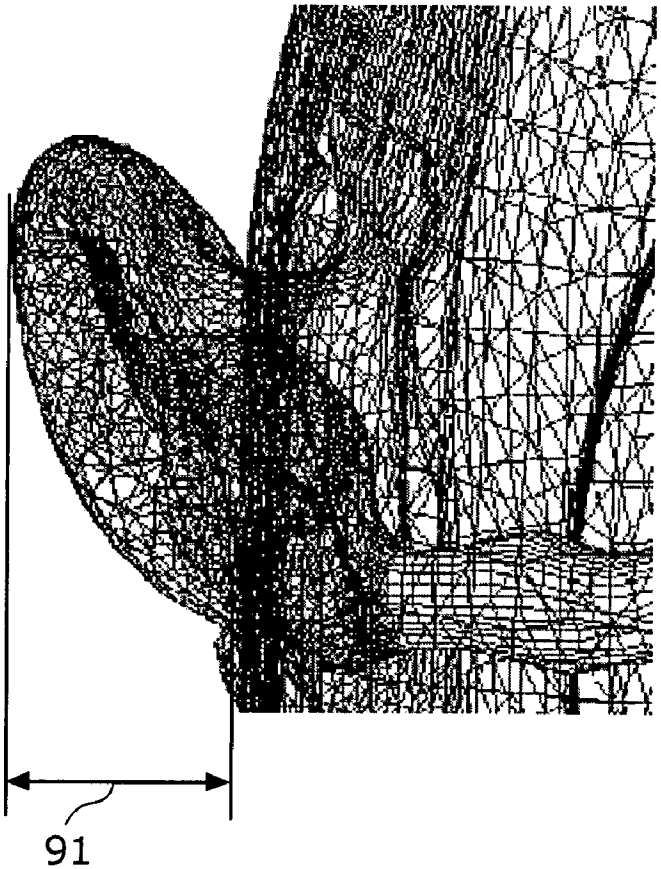
FIG. 26B is a top view showing in detail the pinna region.
Figure 26A:
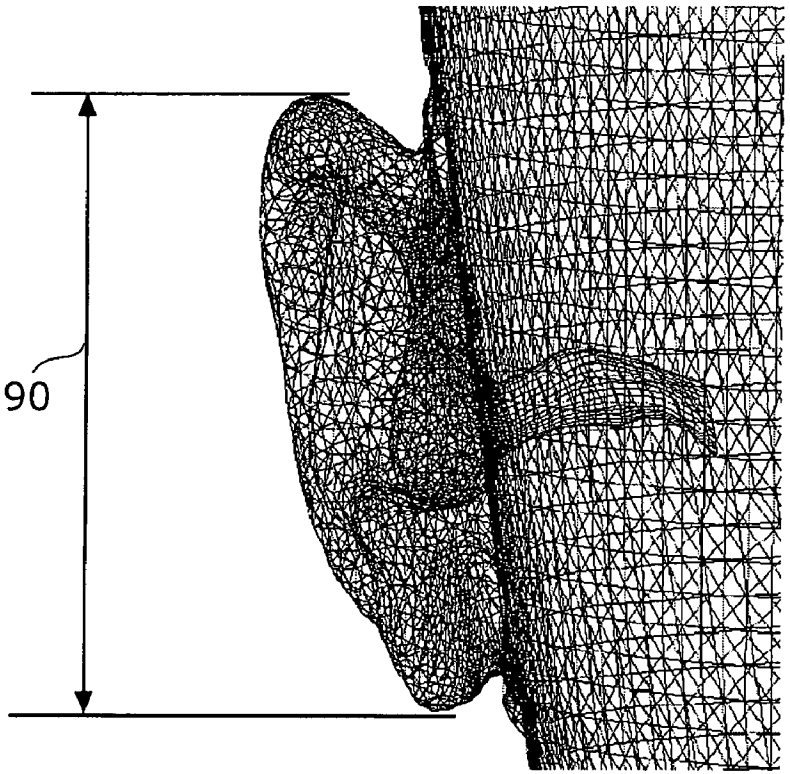
FIG. 26A is a front view showing in detail a pinna region.

FIG. 26 is a diagram showing a pinna region about which specific categories are defined, the specific categories being in the parent population to which the sound image control device of the eighth embodiment is provided. FIG. 26A is a front view showing in detail a pinna region, and FIG. 26B is a top view showing in detail the pinna region. In FIG. 26, 90 indicates the height of the pinna region, and 91 indicates the width of the pinna region that is represented by a distance to the most distant location from the outer surface of the head. FIG. 27 is a table showing a further another example of specific categories in the parent population to which the sound image control device of the seventh embodiment is provided. In FIG. 27, the head models M91 to M99 are defined by categorizing these head models into three types according to the height of their pinna regions, eh1, eh2, and eh3, and by categorizing these head models into three types according to the width of their pinna regions ed1, ed2, and ed3. In this case too, using the head models M91 to M99 that are obtained by previously modifying the dimensions of the head model 3 according to the dimensions shown in FIG. 27, each transfer function is determined by a numerical calculation, and correction filter characteristics E1-91, E2-91, . . . , E1-99, and E2-99 are determined and stored into the memory, as in the case of the sixth embodiment.

Figure 28:
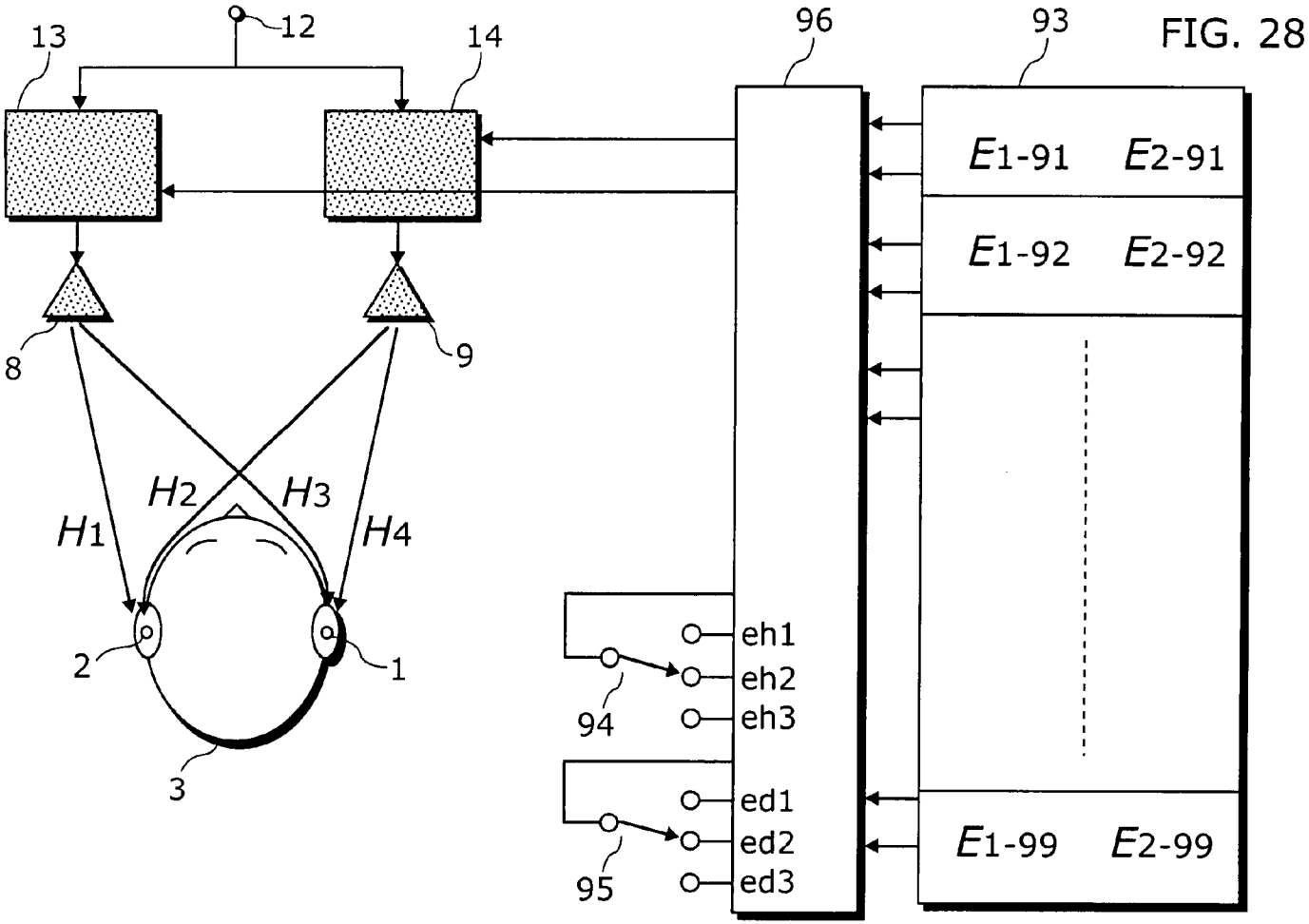
FIG. 28 is a block diagram showing a structure in which correction filter characteristics for head models are switched according to the specific categories categorized into nine types as shown in FIG. 27.

FIG. 28 is a block diagram showing a structure in which correction filter characteristics for head models are switched according to the specific categories categorized into nine types as shown in FIG. 27. In FIG. 28, the sound image control device includes: a characteristic storage memory 93 that stores the correction filter characteristics E1-91, E2-91, . . . , E1-99, and E2-99 that are calculated for the nine types of the head models shown in FIG. 27; a switch 94 for switching correction filters depending on which one of the three heights eh1, eh2, and eh3 the pinna region has; a switch 95 for switching correction filters depending on which one of the three widths ed1, ed2, and ed3 the pinna region has; and a filter setting unit 96 that selects corresponding correction filter characteristics from the characteristic storage memory 93 according to the respective states of the switch 94 and switch 95, and sets the selected correction filter characteristics to the correction filter 13 and the correction filter 14. By a listener selecting optimum correction filter characteristics for him/her based on a combination of the states of the switch 94 and switch 95, it is possible to reduce a difference in the effect of sound image control among listeners attributable to their height and width of the pinna regions.

Note that in the first to eighth embodiments described above, when the potentials at the respective nodal points on the head model are calculated, such calculations of potential data for the respective nodal points are performed offline since an enormous amount of calculations are required to be performed. Then, the obtained potentials are once stored into an external database or the like, and then transfer functions are calculated using such obtained potentials so as to calculate the characteristic functions of the correction filters. Processing up until this is executed by an external tool. This means that, with the above-described sound image control device, the characteristic functions of the correction filers are simply stored in a memory such as a ROM and used. This is due to the fact that a sound image control device implemented on a mobile device, such as a mobile phone and a headphone stereo, is not currently capable of supporting the above amount of calculations. Thus, it is considerable that a sound image control device contained in a mobile device is required to be capable of a larger amount of processing in the near future.

Figure 29:
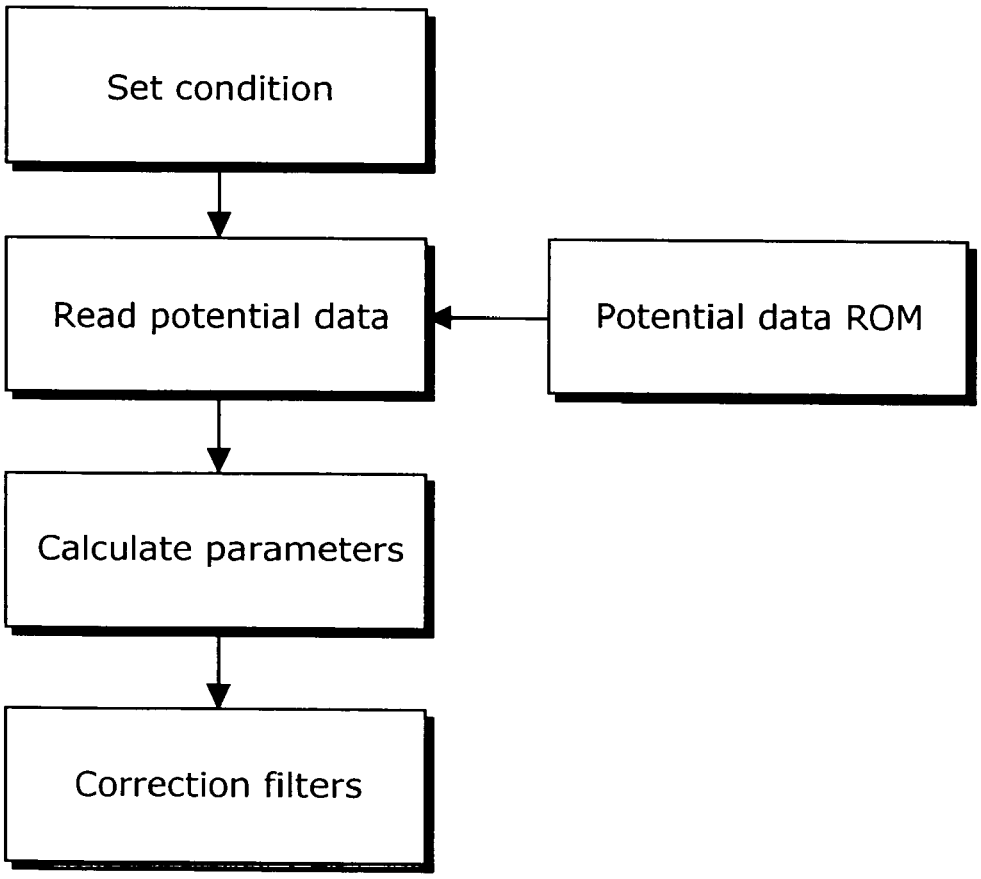
FIG. 29 is a diagram showing a processing procedure taken by the sound image control device in the case where a set of potential data for plural types of head models are stored in the sound image control device.

FIG. 29 is a diagram showing a processing procedure taken by the sound image control device in the case where a set of potential data for plural types of head models are stored in the sound image control device. For example, a listener selects, as part of condition setting, a head model optimum for him/her as shown in the fifth to eighth embodiments, looking at the menu screen of the sound image control device. Here, a detailed condition may also be inputted such as a positional relationship between a speaker and the respective ears and a positional relationship between the target sound source and the respective ears. In response to this, the sound image control device reads, from the ROM storing the set of potential data, potential data corresponding to the selected head model, and generates predetermined transfer functions. Such transfer functions may be generated based on predetermined positional relationships between a speaker and the respective ears as well as between the target sound source and the respective ears, or may be calculated based on data first inputted by a listener as part of a condition setting, such as a positional relationship between the target sound source and the respective ears. Next, parameters (characteristic functions) for the correction filters are calculated from the obtained transfer functions to be set to the correction filters. As described above, by making it possible to perform, inside the sound image control device, processing up until calculations of characteristic functions for the correction filters using the internally stored potential data, it becomes possible to modify the characteristics of the correction filters in a flexible manner depending on various conditions at different times and to localize sound images in a more precise manner.

Figure 30:
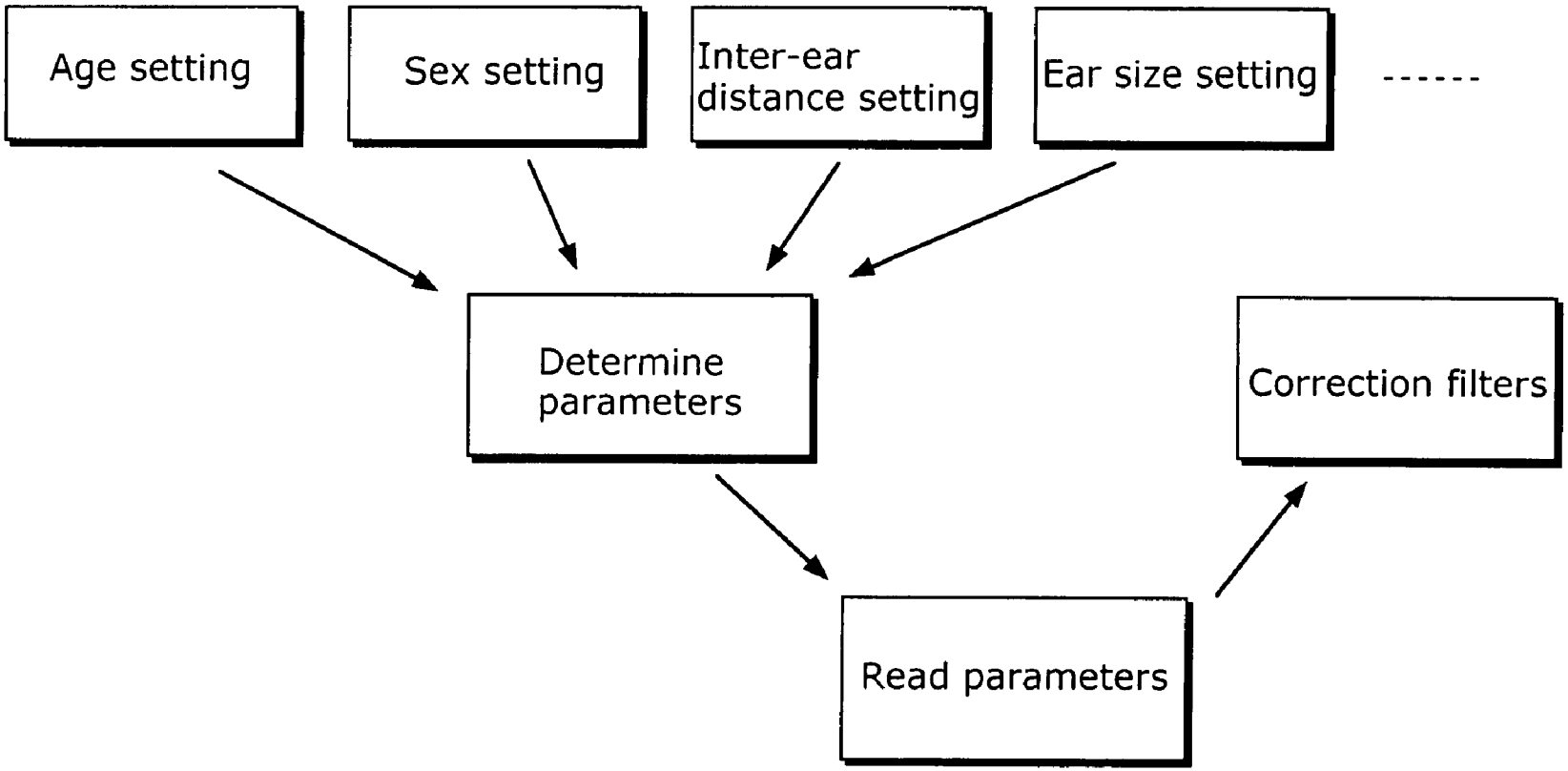
FIG. 30 is a diagram showing an example procedure for setting characteristic functions in the case where the sound image control device of the present invention or an acoustic device including it is equipped with a setting input unit that accepts inputs for setting plural items based on which a type of a head model is determined.

FIG. 30 is a diagram showing an example procedure for setting characteristic functions in the case where the sound image control device of the present invention or an acoustic device including it is equipped with a setting input unit that accepts inputs for setting plural items based on which a type of a head model is determined. Also, another example structure is further described in which the setting input unit equipped to the sound image control device or an acoustic device including it accepts items concerning the listener such as age, sex, inter-ear distance, and the ear size based on which a type of a head model is determined. In this case, the sound image control device previously holds, in a tabular form or the like, parameters (E1 and E2) so that a set of parameters (characteristic functions) (E1 and E2) is determined for the items concerning the listener such as age, sex, inter-ear distance, and the ear size. Accordingly, when items such as the age "30 years old", the sex "female", the inter-ear distance "150 mm", and the ear size "55 mm" are inputted, for example, one set of parameters corresponding to these items is determined. Next, the determined set of characteristic functions is read out from the ROM, and set to the correction filter 13 and the correction filter 14. As described above, by the sound image control device equipped with the setting input unit, it is possible to set characteristic functions that are appropriate for various setting items, and to set more appropriate correction filters on a listener-by-listener basis.

FIG. 31 is a diagram showing an example procedure taken by the sound image control device equipped with the setting input unit shown in FIG. 30 in the case where the listener performs an input for the setting while listening to the sound from a speaker. In this case, the inputs of items are accepted, for example, in order of influence of such items in the determination of a type of a head model. In the case where the influence of items is stronger in order of age, sex, inter-ear distance, and ear size, for example, in the determination of a type of a head model, inputs for the setting are accepted in the following order: (setting 1) setting of the age→(setting 2) setting of the sex→(setting 3) setting of the inter-ear distance→(setting 4) setting of the ear size. Following this order, the listener performs inputs for the setting while listening to the sound from the speaker. For example, when the listener thinks that the setting has been customized correctly enough at the point in time when such listener has finished inputting the age "30 years old", the sex "female", and the inter-ear distance "150 mm", the default value is used for the rest of the setting, i.e., (setting 4) the ear size. Accordingly, one set of parameters is determined according to the items inputted for the setting. Then, the determined set of characteristic functions are read out from the ROM, and set to the correction filter 13 and the correction filter 14. This structure allows the listener not to perform input operations more than necessary, as well as producing the effect of being able to localize sound images in such a precise manner as satisfies each individual.

Figure 32:
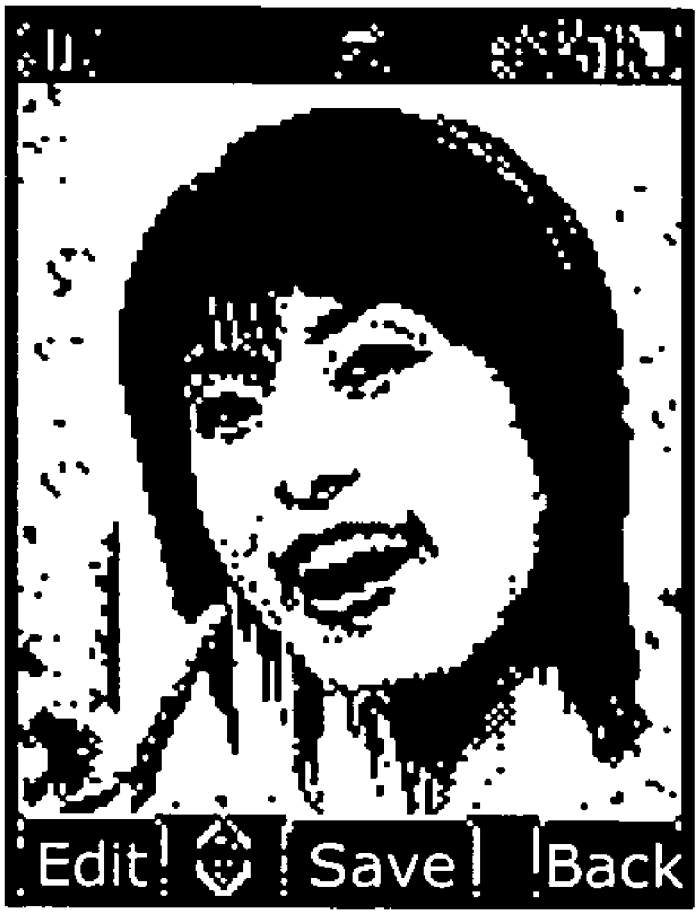
FIG. 32 is a diagram showing an example of supporting the inputs to the setting input unit shown in FIG. 31 based on an image of the face of a person taken by a mobile phone.

Meanwhile, recent mobile devices such as mobile phones are equipped with a camera, which has made it easy to take pictures of persons. Under these circumstances, there is ongoing development, in these days, of the technology for obtaining the dimensions of a head model for a person included in an image taken by a digital camera. FIG. 32 is a diagram showing an example of supporting the inputs to the setting input unit shown in FIG. 31 based on an image of the face of a person taken by a mobile phone. While it is not expected to obtain the perfectly correct values from the picture shown in this drawing, it is possible to determine, for example, the listener's inter-ear distance, distance between the terminal and the user (listener), age, sex or the like. As described above, a set of parameters may be determined using data obtained from a picture, if it is possible, without having to require a listener to perform inputs for the setting. Meanwhile, if there is a dramatic improvement in the computational capacity of mobile devices in the future along with the sophistication of mobile devices, it is considerable that there is also a dramatic improvement in the function of cameras equipped to mobile phones. If such is the case, it becomes possible for the sound image control device, based on an image taken by a camera equipped to a mobile phone, to perform morphing on the head model, calculate the potentials at the respective nodal points, and store them into a memory or the like. It becomes further possible for the sound image control device to calculate HRTFs using the stored potentials, calculate characteristic functions optimum for the person shot in the picture, and set the calculated characteristic functions to the correction filters.

Figure 33:
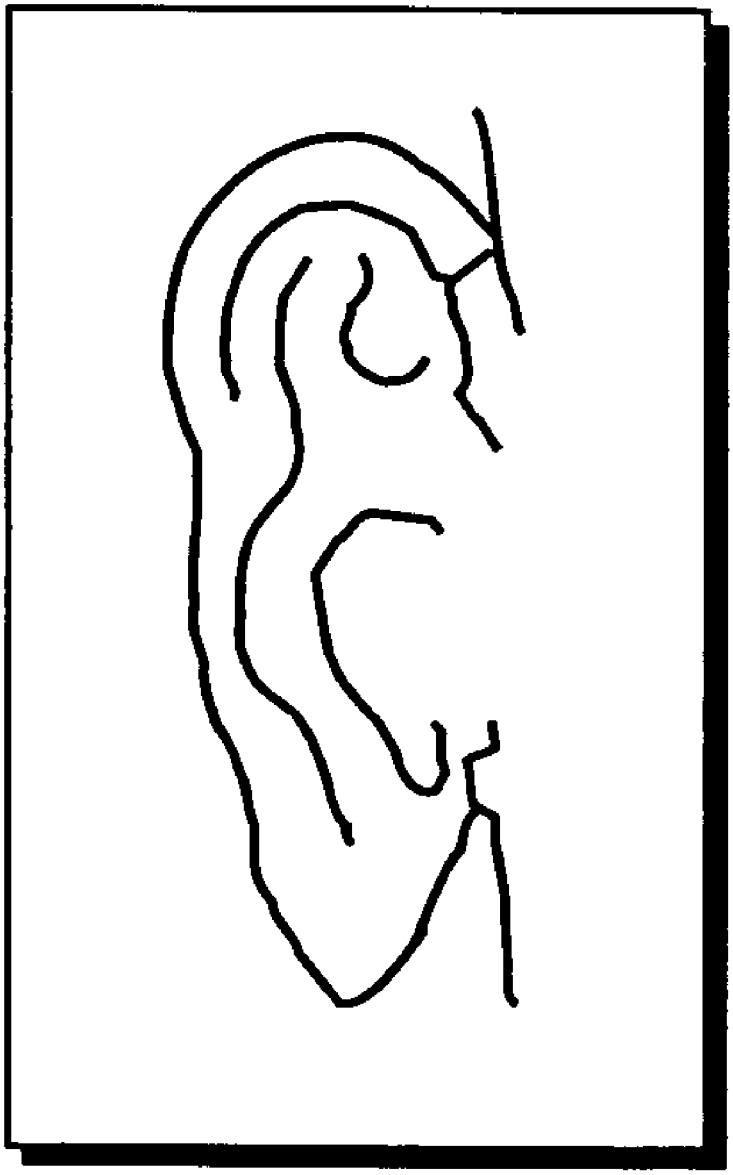
FIG. 33 is a diagram showing an example of supporting the inputs based on a picture in which a pinna region is shot, in order to compensate for the disadvantage of being difficult to take an image that shows the shape of the ears when a picture of a person is normally taken from the front.

FIG. 33 is a diagram showing an example of supporting the inputs based on a picture in which a pinna region is shot, in order to compensate for the disadvantage of being difficult to take an image that shows the shape of the ears when a picture of a person is normally taken from the front. In the case of a picture in which a person is shot from the front as shown in FIG. 32, it happens in many cases that such person's ear (pinna) shape, ear length, angle of a pinna to the head, and position of an ear with respect to the head cannot be recognized due to his/her hair or the shooting angle with respect to the ear. Thus, it is also possible to take an image of only an ear of such person, and combine it with the data obtained from the picture shown in FIG. 32 shot from the front, so as to use the resultant to support the inputs for the setting for determining a set of parameters for the correction filters. It is of course possible to determine a set of parameters for the correction filters based only on data obtained from the above two pictures.

Figure 34:
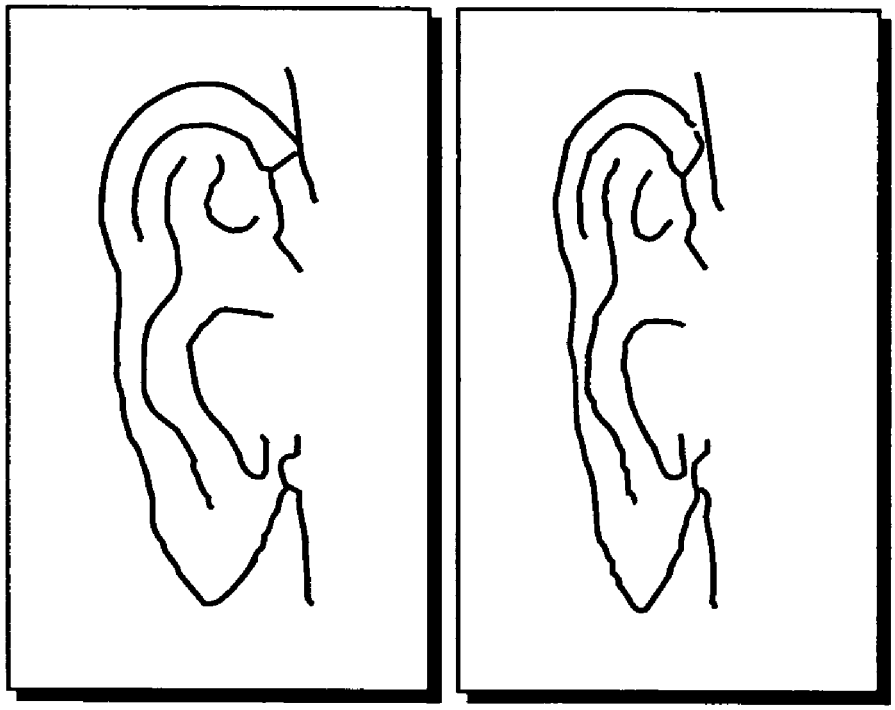
FIG. 34 is a diagram showing the case where a stereoscopic image of the same side of the ears is taken by using a stereo camera or by taking an image of such ear twice.

FIG. 34 is a diagram showing the case where a stereoscopic image of the same side of the ears is taken by using a stereo camera or by taking an image of such ear twice. As shown in this drawing, by using a stereo camera or by taking an image of the ear twice, it is possible to obtain three-dimensional data of the pinna region. Accordingly, it is possible to obtain more effective data than the picture of a pinna region, shown in FIG. 33, obtained by a single shooting. In this case too, it is also possible to combine such data with the data obtained from the picture shown in FIG. 32 shot from the front, so as to use the resultant to support the inputs for the setting for determining a set of parameters for the correction filters, or to determine a set of parameters for the correction filters based only on data obtained from the two pictures. It is of course possible to obtain further precise data by taking an image three times or more.

Figure 35:
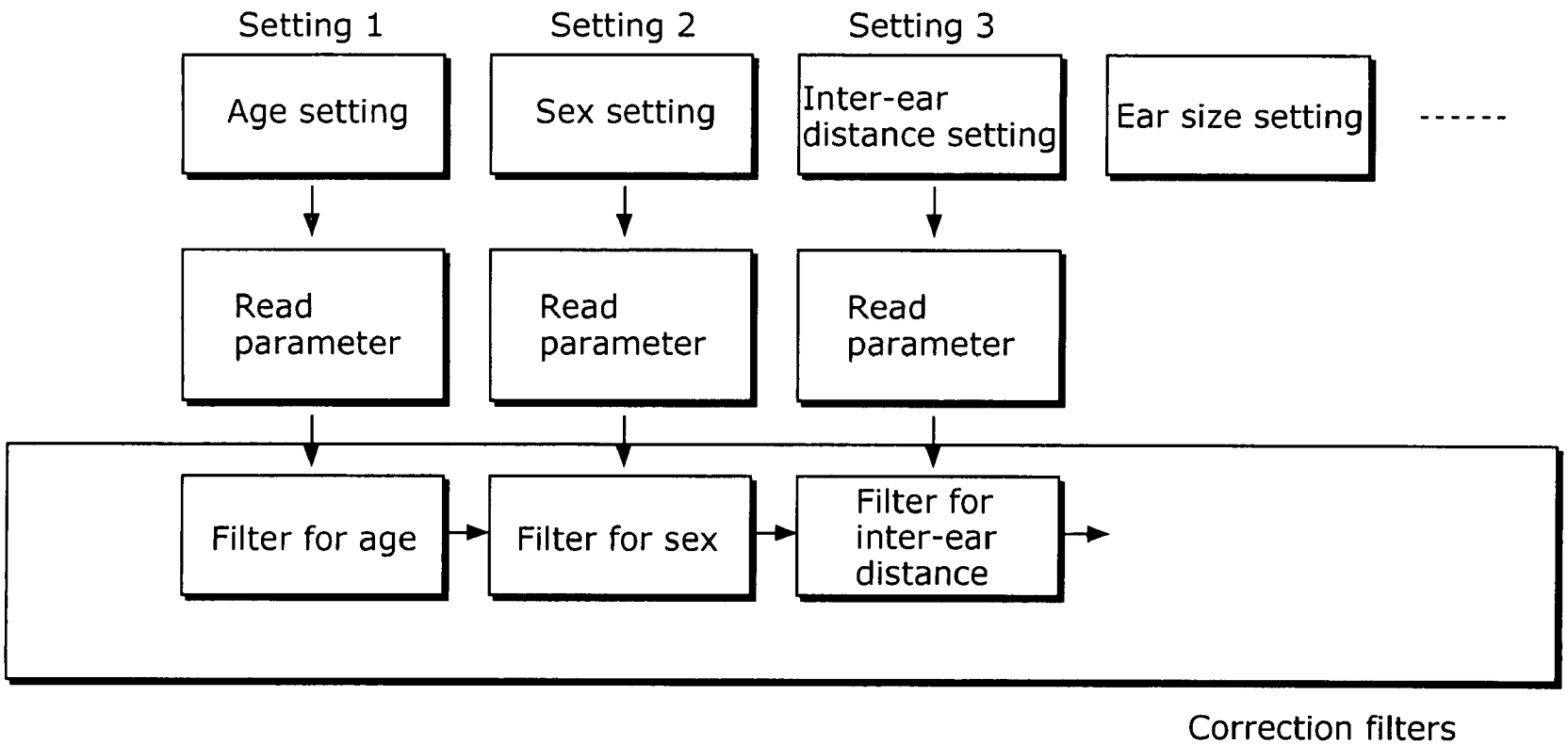
FIG. 35 is a diagram showing an example processing procedure to be taken in the case where the sound image control device or an acoustic device including it holds characteristic functions for the correction filters for each item inputted for the setting.

Note that the sound image control device of the present invention may hold characteristic functions for the correction filters on an item-by-item basis, rather than holding characteristic functions for the correction filters for all combinations of items inputted for the setting, unlike the examples shown in FIG. 30 and FIG. 31. FIG. 35 is a diagram showing an example processing procedure to be taken in the case where the sound image control device or an acoustic device including it holds characteristic functions for the correction filters for each item inputted for the setting. Here, a description is also given for the case where inputs for the setting are accepted in order of (setting 1) setting of the age→(setting 2) setting of the sex→(setting 3) setting of the inter-ear distance→(setting 4) setting of the ear size, and the listener performs inputs for the setting while listening to the sound from the speaker, according to this order. For example, when the listener makes an input of "30 years old" as the age, a set of parameters corresponding to the age "30 years old" is read from sets of parameters (characteristic functions) for age, and is set to "filter for age" in the correction filters. Then, when the listener makes an input of "female" as the sex, a set of parameters corresponding to the sex "female" is read from sets of parameters (characteristic functions) for sex, and is set to "filter for sex" in the correction filters. Furthermore, when the listener makes an input of "150 mm" as the inter-ear distance, a set of parameters corresponding to the inter-ear distance "150 mm" is read from sets of parameters (characteristic functions) for inter-ear distance, and is set to "filter for inter-ear distance" in the correction filters. For example, when the listener thinks that the setting has been customized correctly enough at the point in time when such listener has finished inputting items up until this, the default values originally set to "filter for ear size", are used as a set of parameters for the rest of the setting, i.e., (setting 4) the ear size. When the listener's inputs for the setting are regarded as OK, the sound image control device combines the characteristic functions set to "filter for age", "filter for sex", "filter for inter-ear distance", and "filter for ear size" and the like so as to generate a set of parameters (characteristic functions), and sets it to the correction filter 13 and the correction filter 14. This structure makes it unnecessary to hold all sets of parameters determined by a set of items such as age and sex as well as making it possible to reduce the memory size of the sound image control device.

Figure 36:
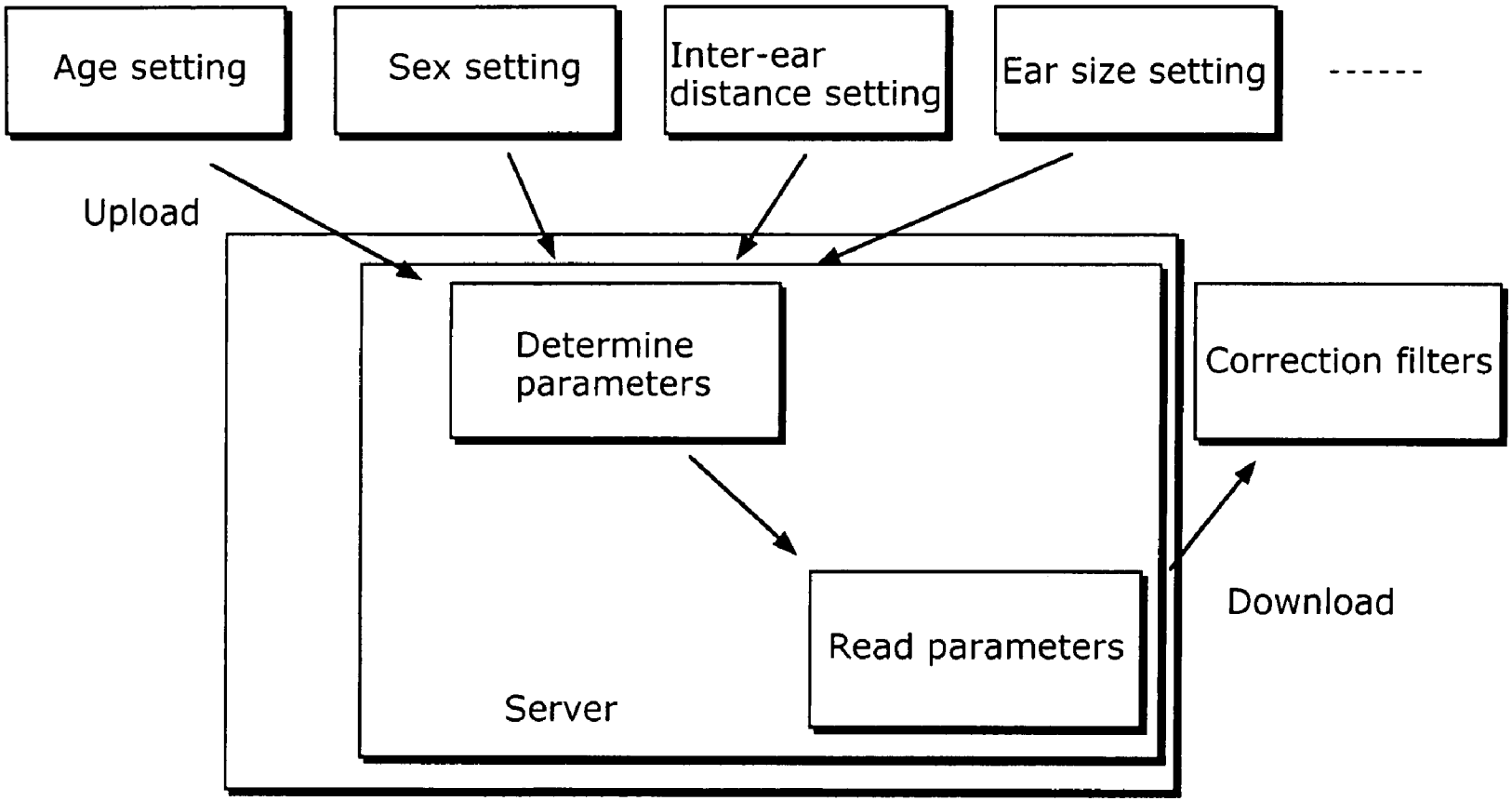
FIG. 36 is a diagram showing an example case where a mobile phone or the like equipped with the sound image control device sends data inputted via the setting input unit or the like to a server on the Internet, and is then provided with optimum parameters based on the data it has sent.

FIG. 36 is a diagram showing an example case where a mobile phone or the like equipped with the sound image control device sends data inputted via the setting input unit or the like to a server on the Internet, and is then provided with optimum parameters based on the data it has sent. As shown in this drawing, in the mobile phone or the like equipped with the sound image control device, values indicating the age, sex, inter-ear distance, and ear size are inputted from the setting input unit or the like. When the listener completes the inputs for the setting, the sound image control device connects to a server on the Internet such as a vendor via a communication line such as a mobile telephone network, and uploads, to the server, the data inputted for the setting such as age, sex, inter-ear distance, and ear size. Based on such uploaded setting values, the server determines parameters that are judged as being optimum for the listener having the uploaded setting values, and reads such determined set of parameters from a database in the server so as to cause the mobile phone to download them. This structure makes it unnecessary for the sound image control device to hold many sets of parameters, resulting in the reduction in memory load. Furthermore, since the server has a mainframe computer system, it is possible for the server to hold, in a database, more detailed data about each item. For example, while the sound image control device equipped in a mobile phone has the setting of ages in which ages are set by five-year increment such as the age 10, 15, 20, 25, 30, . . . , the database of the server is capable of holding the setting of ages that allows different parameters to be assigned on an age basis. Thus, the mobile phone is not required to use a large amount of memory as well as the effect is produced of being able to obtain a more suitable set of parameters.

Figure 37:
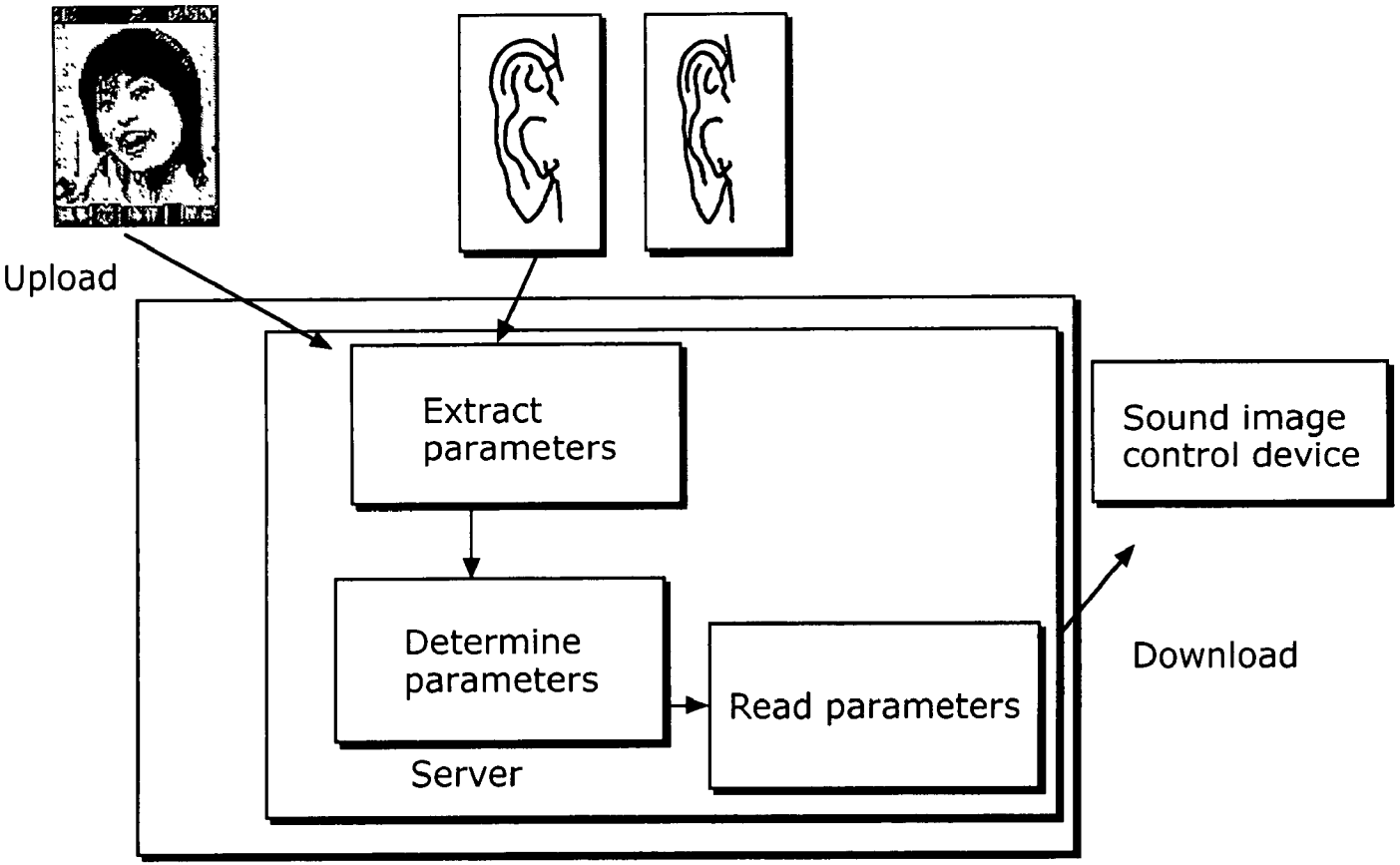
FIG. 37 is a diagram showing an example case where a mobile phone or the like equipped with the sound image control device sends data of an image taken by a camera or the like equipped to it to a server on the Internet, and is then provided with optimum parameters based on the image data it has sent.

FIG. 37 is a diagram showing an example case where a mobile phone or the like equipped with the sound image control device sends data of an image taken by a camera or the like equipped to it to a server on the Internet, and is then provided with optimum parameters based on the image data it has sent. As shown in FIG. 37, even in the case where image data of a picture taken by the mobile phone is sent to the server rather than inputting age, sex, and inter-ear distance, and the like for the setting, the mobile phone or the like is inferior to the server in terms of computer resources such as memory capacity and CPU processing speed. Thus, compared with image data analysis of the server, the mobile phone or the like cannot obtain such detailed and precise data as can be obtained by image data analysis of the server even if the same image data is analyzed. In contrast, as in the case shown in FIG. 36, the computer system of the server contains the amount of software or the like that is enough to obtain more precise data from image data uploaded. This therefore makes it possible for the mobile phone equipped with the sound image control device to save calculator resources and to obtain a more precise set of parameters, as well as producing the effect of being able to localize more precise sound images.

Figure 38:
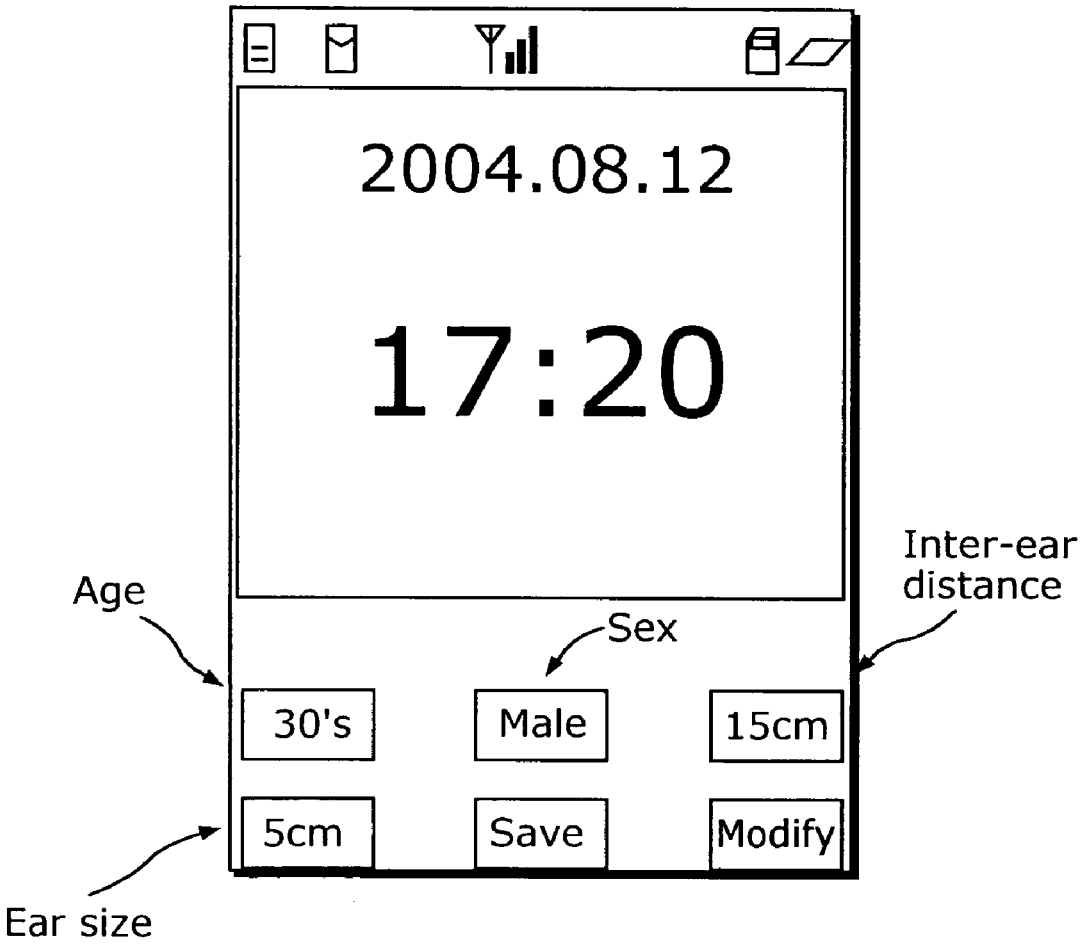
FIG. 38 is a diagram showing an example case where a mobile phone or the like equipped with the sound image control device includes a display unit that displays each personal item concerning a listener used for the setting of parameters.

FIG. 38 is a diagram showing an example case where a mobile phone or the like equipped with the sound image control device includes a display unit that displays each personal item concerning a listener used for the setting of parameters. An icon that does not necessarily have to be displayed at normal time is displayed on the standby screen of the mobile phone, but when the listener listens to music or the like using the sound image control device, it is possible, to display, at the bottom of the display unit, his/her personal setting items for which a set of parameters (characteristic functions) for the correction filters are determined, as shown in FIG. 38.

In this drawing, it is shown as an example that the listener's age is "30's", sex is "male", inter-ear distance is "15 cm", and ear size is "5 cm". By displaying the current setting state in the above manner, the effect is produced of making it possible for the listener to perform fine-tuning using different values if such listener is not satisfied with the current localization of sound images.

Figures 39A, 39B:
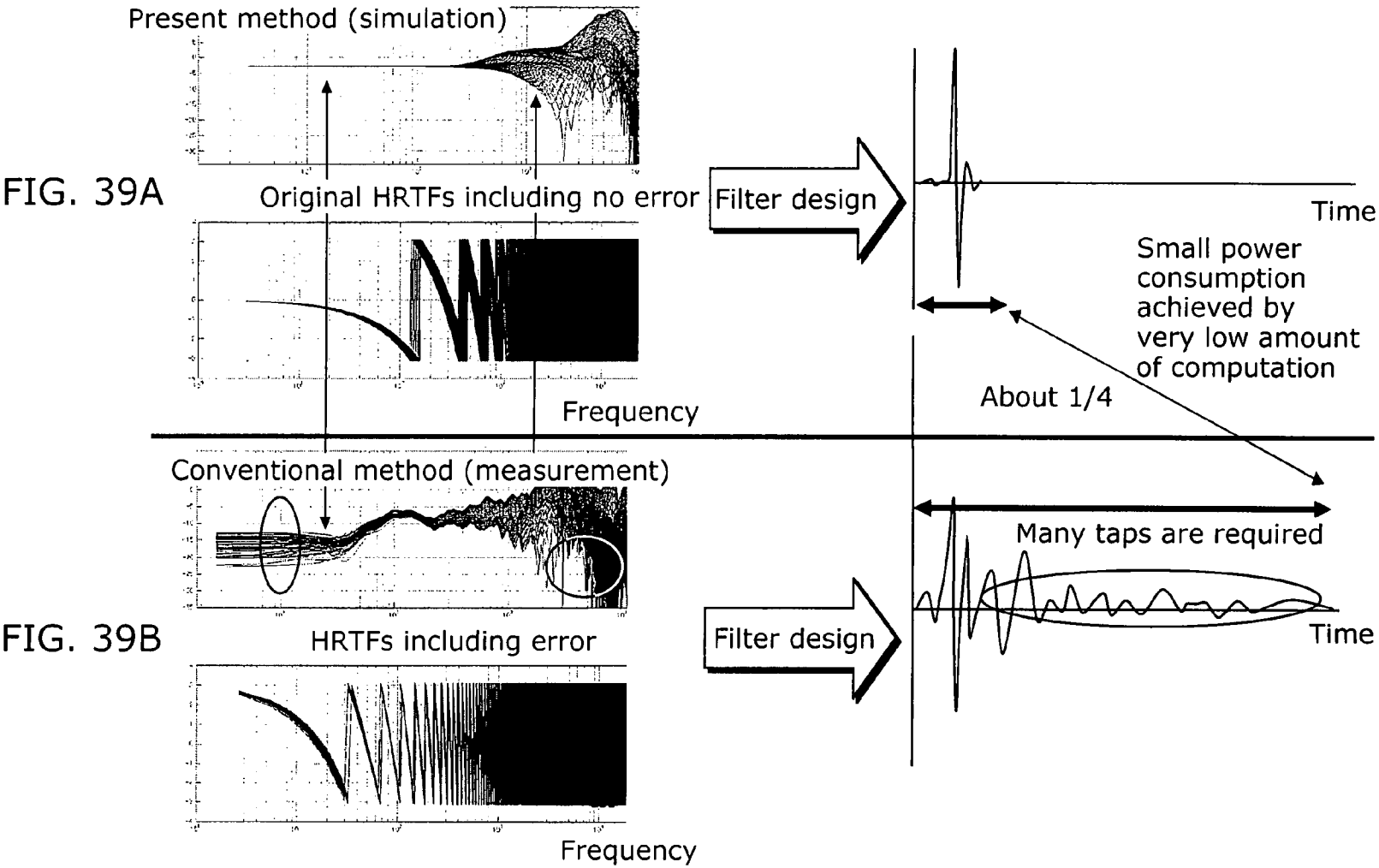
FIG. 39A is a graph showing a waveform and phase characteristics of transfer functions obtained by the simulation in the aforementioned first to eighth embodiments.
FIG. 39B is a graph showing a waveform and phase characteristics of transfer functions obtained by actual measurement as in the conventional case.

FIG. 39A is a graph showing a waveform and phase characteristics of transfer functions obtained by the simulation in the aforementioned first to eighth embodiments. FIG. 39B is a graph showing a waveform and phase characteristics of transfer functions obtained by actual measurement as in the conventional case. Note that input sounds used for measurement shown in FIG. 39A and FIG. 39B are white noises that are flat to all frequencies. As shown in FIG. 39A, in the case of original HRTFs, the sound pressure becomes very low at a certain frequency even if the sound is a white noise as shown in this simulation. However, the graph for actual measurement shown in FIG. 39B shows variations around such frequency. This means that such an error is produced in the case of actual measurement. In the actual measurement shown in FIG. 39B, direction dependency is witnessed in HRTFs corresponding to the low frequency part due to the error. Thus, about only one fourth of taps is required in the case of the simulation in order to determine characteristic functions for the correction filters to output an input white noise as a white noise at the position of the target sound source.

As described above, according to the first to eighth embodiments, since transfer functions are determined not by actual measurement but by a simulation, only a very small amount of computation is required at the time of designing correction filters. As a result, the effect is produced of being able to minimize power consumption.

INDUSTRIAL APPLICABILITY

The sound image control device of the present invention is effective for use as a mobile device, such as a mobile phone and a PDA, equipped with an acoustic reproduction device. The sound image control device of the present invention is also effective for use as a sound image control device contained in a game machine for playing virtual games and the like.

The invention claimed is:

1. A design tool for designing a sound image control device that generates a second transfer function by filtering a first transfer function indicating a transfer characteristic of a sound from a sound source to a plurality of sound receiving points on a head, the second transfer function indicating a transfer characteristic of a sound from a target sound source to the plurality of sound receiving points on the head, the target sound source being at a location different from a location of the sound source, said design tool comprising a transfer function generation unit including a processor for determining the first and second transfer functions using the plurality of sound receiving points on the head as a plurality of sound emitting points and using the sound source and the target sound source as a plurality of sound receiving points that are not on the head, wherein said transfer function generation unit includes:

a potential calculation unit calculating potentials at respective nodal points on a mesh that is set on an outer surface of a three-dimensional head model representing the head, the potentials being calculated only once for each of the sound emitting points on right and left sides of the three-dimensional head model;

a first transfer function generation unit generating the first transfer function by combining the potentials calculated by said potential calculation unit; and a second transfer function generation unit generating the second transfer function by combining the potentials calculated by said potential calculation unit.

2. The design tool for the sound image control device according to claim 1, wherein a sound emitting point of the plurality of sound emitting points which is a sound receiving point of the plurality of sound receiving points on the head is located close to an entrance to an external ear canal of a three-dimensional head model using a dummy head.

3. The design tool for the sound image control device according to claim 1, wherein sound emitting point of the plurality of sound emitting points which is a sound receiving point of the plurality of sound receiving points on the head is an eardrum of a three-dimensional head model using a dummy head.

4. The design tool for the sound image control device according to claim 1, further comprising:

a characteristic function calculation unit calculating a filtering characteristic function used to convert the first transfer function into the second transfer function by filtering the first transfer function; and a characteristic function setting unit setting the calculated filtering characteristic function to a filter of the sound image control device.

5. The design tool for the sound image control device according to claim 1, wherein the head model includes a plurality of types of head models whose size of each part is different from another head model, and said potential calculation unit calculates the potentials for each of the plurality of types of head models.

6. The design tool for the sound image control device according to claim 5, wherein one of the plurality of types of head models is a head model whose size of each part is set to an average of statistics about body dimensions of persons in a predetermined group.

7. The design tool for the sound image control device according to claim 5, wherein the plurality of types of head models are head models whose size of each part is set based on statistics about body dimensions of persons of at least different sexes in a predetermined group.

8. The design tool for the sound image control device according to claim 5, wherein the plurality of types of head models are head models whose size in each part is set based on statistics about body dimensions of persons of at least different ages in a predetermined group.

9. The design tool for the sound image control device according to claim 5, wherein the plurality of types of head models are head models whose size in each part is set based on at least any of body dimensions of persons in a predetermined group, the body dimensions being one of head width, head height, and head depth, each being divided into several levels.

10. The design tool for the sound image control device according to claim 5, wherein the plurality of types of head models are head models whose size in each part is set based on at least a dimension of each part of a pinna of persons in a predetermined group, the dimension of each part of the pinna indicating an outer shape of the pinna and being divided into several levels.

11. The design tool for the sound image control device according to claim 5, further comprising:

a type-specific characteristic function calculation unit calculating a filtering characteristic function for each of the plurality of types, the filtering characteristic function being used to convert the first transfer function into the second transfer function by filtering the first transfer function; and a type-specific characteristic function setting unit storing, into a memory of the sound image control device, the calculated filtering characteristic function for each of the plurality of types.

12. The design tool for the sound image control device according to claim 1, wherein said design tool further comprises a potential storage unit storing, into a memory of the sound image control device, data of the calculated potentials.

13. A mobile device comprising:

a digital camera that takes an image;

an acoustic transducer that converts an electric signal into a sound; and a sound image control device that generates a second transfer function by filtering a first transfer function indicating a transfer characteristic of the sound from the acoustic transducer, which is a sound source, to a plurality of sound receiving points on a head, the second transfer function indicating a transfer characteristic of a sound from a target sound source to the plurality of sound receiving points on the head, the target sound source being at a location different from a location of the sound source, wherein said mobile device further comprises a size analysis unit analyzing sizes of respective parts on a head of a listener based on a picture of the listener taken by said digital camera, and wherein said sound image control device (i) calculates potentials at respective nodal points by performing morphing on a model of the head based on the analyzed sizes of the respective parts on the head, the potentials being calculated only once for a plurality of sound emitting points by using the plurality of sound receiving points on the model of the head as the plurality of sound emitting points for which the potentials are calculated and by using the sound source and the sound target as a plurality of sound receiving points that are not on the model of the head, and (ii) calculates a characteristic function from the calculated potentials, the characteristic function being used to perform a filtering operation on the first transfer function.

* * * * *

UNITED STATES PATENT AND TRADEMARK OFFICE

CERTIFICATE OF CORRECTION

PATENT NO. : 7,664,272 B2
APPLICATION NO. : 10/554595
DATED : February 16, 2010
INVENTOR(S) : Kenichi Terai et al.

It is certified that error appears in the above-identified patent and that said Letters Patent is hereby corrected as shown below:

On the Title Page

In Section (56) References Cited, under the "FOREIGN PATENT DOCUMENTS" heading, "WO 02/007197" should read -- WO 02/07197 --.

In Section (56) References Cited, under the "OTHER PUBLICATIONS" heading, please insert the following reference:
-- Nobuyuki USUKI et al., entitled "1-P-24 USEFULNESS OF A MECHANICAL MODEL OF THE HUMAN VOCAL TRACT FOR EDUCATION IN SPEECH SCIENCE-PERTURBATION THEORY IN VOWEL PRODUCTION," Nihon-onkyogakkai-ronbunsyu, pages 403-404, October 21, 2001. --.

Signed and Sealed this

Third Day of August, 2010

David J. Kappos

David J. Kappos
*Director of the United States Patent and Trademark Office*